US006601792B2

(12) United States Patent
Komatsu et al.

(10) Patent No.: US 6,601,792 B2
(45) Date of Patent: Aug. 5, 2003

(54) WINDING DEVICE

(75) Inventors: Fumito Komatsu, Nagano (JP); Noboru Ueno, Nagano (JP); Kiyotsugu Takasawa, Nagano (JP)

(73) Assignees: Sankyo Seiki Mfg. Co., Ltd., Nagano-ken (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/827,404

(22) Filed: Apr. 6, 2001

(65) Prior Publication Data

US 2001/0054666 A1 Dec. 27, 2001

(30) Foreign Application Priority Data

Apr. 7, 2000 (JP) ..... 2000-107184

(51) Int. Cl.[7] ..... B65H 59/02
(52) U.S. Cl. ..... 242/420.6; 242/548
(58) Field of Search ..... 242/420.6, 534.1, 242/534.6, 548; 346/136; 347/215, 218; 101/181, 228, 215, 219

(56) References Cited

U.S. PATENT DOCUMENTS

| | | | | | |
|---|---|---|---|---|---|
| 2,345,656 | A | * | 4/1944 | Calleson et al. | 242/420.6 |
| 4,893,763 | A | * | 1/1990 | Wales et al. | 242/420.6 |
| 4,953,808 | A | * | 9/1990 | Craycraft | 242/420.6 |
| 5,503,702 | A | * | 4/1996 | Filicicchia et al. | |
| 5,611,272 | A | * | 3/1997 | Steuer | 101/228 |
| 5,632,455 | A | * | 5/1997 | Stein | 242/538.3 |
| 5,911,382 | A | * | 6/1999 | Wilson | 101/228 |

* cited by examiner

*Primary Examiner*—William A. Rivera
(74) *Attorney, Agent, or Firm*—Reed Smith LLP

(57) ABSTRACT

A winding device is disclosed comprising a winding mechanism for winding a thin medium, such as paper, film and cloth and the like, output by a printer on a winding core. A looseness-detecting sensor is provided for detecting looseness of the medium and for actuating the winding mechanism upon detection. When a sheet tray is attached to the printer, the looseness-detecting sensor is capable of receding from the moving area of the medium.

3 Claims, 26 Drawing Sheets

WINDING DEVICE

BACKGROUND OF THE INVENTION a) Field of the Invention

The present invention relates to a winding device suitable for winding media such as roll papers output by a large-scale printer. More specifically, the present invention relates to a winding device equipped with a looseness-detecting sensor for detecting the looseness of the output media.

b) Description of the Prior Art

Normally used as drawing media for large-scale full color printers (of ink jet or electrostatic recording types) are papers, films, or cloths which are wound around a pipe-like paper tube made of cardboard. In particular, the medium printed in high resolution is a high value added product, so extra careful handling is required for storing the medium after printing.

One of the means for storing the medium after printing is, as illustrated in FIGS. 26 and 27, a method for winding a printed medium 100 on a paper tube 102 using a winding device 101 to store the wound-up medium 100 in a roll. This method is suitable when a laminate treatment is provided in a following process because the roll medium 100, rather than cut sheets, can be processed continuously.

In such a winding device 101, the paper tube 102 as a winding core is held on both sides and secured by flanges 103, and a front edge of the medium 100 printed by a printer 104 is attached to the paper tube 102 with scotch-type tape. Here, a cylindrical roller weight 106 is used to tension the medium 100 from a paper outlet 105 of the printer 104 to the flange 103, and a medium guide 107 is provided to prevent interference between the medium 100 and the printer 104.

If the medium 100 becomes loose by more than a predetermined amount as the printer 104 keeps printing out the medium 100, the weight 106 is lowered so that the loose condition is optically detected by a looseness-detecting sensor 108 and the winding flange 103 is driven to wind the medium 100. When the amount of looseness decreases to a predetermined level, the tensioned condition of the medium 100 is detected by the looseness-detecting sensor 108 and the flange 103 stops rotating. Thus, the continuous roll medium 100 is wound by intermittent rotations of the flange 103.

However, since the above mentioned winding device 101 uses the optical looseness-detecting sensor 108, when light-emitting and light-receiving portions of the sensor 108 are contaminated, when a scotch-type tape for attaching the medium 100 on the paper tube 102 is attached on the light-emitting portion or light-receiving portion of the sensor 108 due to careless handling by an operator, or when something is placed between the light-emitting portion and the light-receiving portion of the sensor 108, the looseness of the medium 100 cannot be detected. Consequently the medium 3 cannot be wound.

It is also difficult to adjust the optical axis of the sensor 108 when the light-emitting portion and light-receiving portion of the looseness-detecting sensor 108 are used in the printer 104; even after successful mounting of those elements in the printer, operators may hit the printer and the optical axis of the sensor 108 is shifted. Thus, the accurate positioning of the optical axis of the sensor 108 cannot be guaranteed. For this reason, the detection of the looseness of the medium is not reliable. Further, a wire 109, which connects the light-emitting portion and light-receiving portion of the looseness-detecting sensor 108 and a driving motor of the flange 103, extends over the entire width of the medium 100. Wiring is a complicated operation.

When the printed medium 100 is cut in size of A0, A1, A2, etc., it is necessary to equip a sheet tray 110 for receiving the cut medium 100. However, the medium guide 107 needs to be removed to use the sheet tray 110. Every time the sheet tray 110 is attached/detached, the medium guide 107 also needs to be detached/attached, requiring frequent operations and complicated management of the components.

There is a winding device 101 that does not use the weight 106 and medium guide 107 for winding the medium 100 on the paper tube 102. However, such a conventional winding device 101 is not designed to be used with the sheet tray 110. If the sheet tray 110 is used with the winding device 101 attached, the medium 100 is jammed at the winding device 101. Thus, each time the sheet tray 110 is used, the winding device 101 needs to be removed.

OBJECT AND SUMMARY OF THE INVENTION

Then, a primary object of the present invention is to provide a winding device which does not need to be removed even when the sheet tray is used.

To achieve this object, in a winding device comprising a winding mechanism, which winds a thin medium such as paper, film, or cloth output by a printer on a winding core, and a looseness-detecting sensor, which detects looseness of the medium and actuates the winding mechanism upon the detection, the present invention is characterized by the fact that the looseness-detecting sensor is capable of receding from the moving area of the medium when a sheet tray is attached to the printer.

Thus, when the sheet tray is attached for stocking up the cut medium after printing, the looseness-detecting sensor can be caused to recede from the moving area of the medium. Consequently, the medium is prevented from intruding on the looseness-detecting sensor. Accordingly, there is no need to detach/attach a whole or part of the winding device when the sheet tray is attached/detached. This improves usability and eliminates the management of the components with the exception of the sheet tray.

The invention is further characterized by the fact that, in the winding device as discussed above, the looseness-detecting sensor is a mechanical contact-type sensor that performs detection as the medium comes into contact therewith and is integrated with the winding mechanism.

Since the sensor is of a contact-type, detection is kept accurate while it may be degraded in an optical sensor because the optical axis of the sensor is transgressed intercepted due to contamination or shifted after installation. Thus, reliability of detection can be improved. Because the looseness-detecting sensor is integrated with the winding mechanism, there is no need to wire the sensor with the winding mechanism, which is normally required when the optical sensor is used in the printer. This simplifies the operation of mounting the sensor in the printer. Since a contact-type sensor is generally less expensive than an optical sensor, the cost of components is reduced.

Further, the invention is characterized by the fact that, in the winding device set forth above, a contact lever of the looseness-detecting sensor, with which the medium makes contact, is capable of swinging with a very small force. Therefore, the contact lever is protected from bending or damage when the medium comes into contact therewith.

DESCRIPTION OF THE PREFERRED EMBODIMENTS

Figure 1:
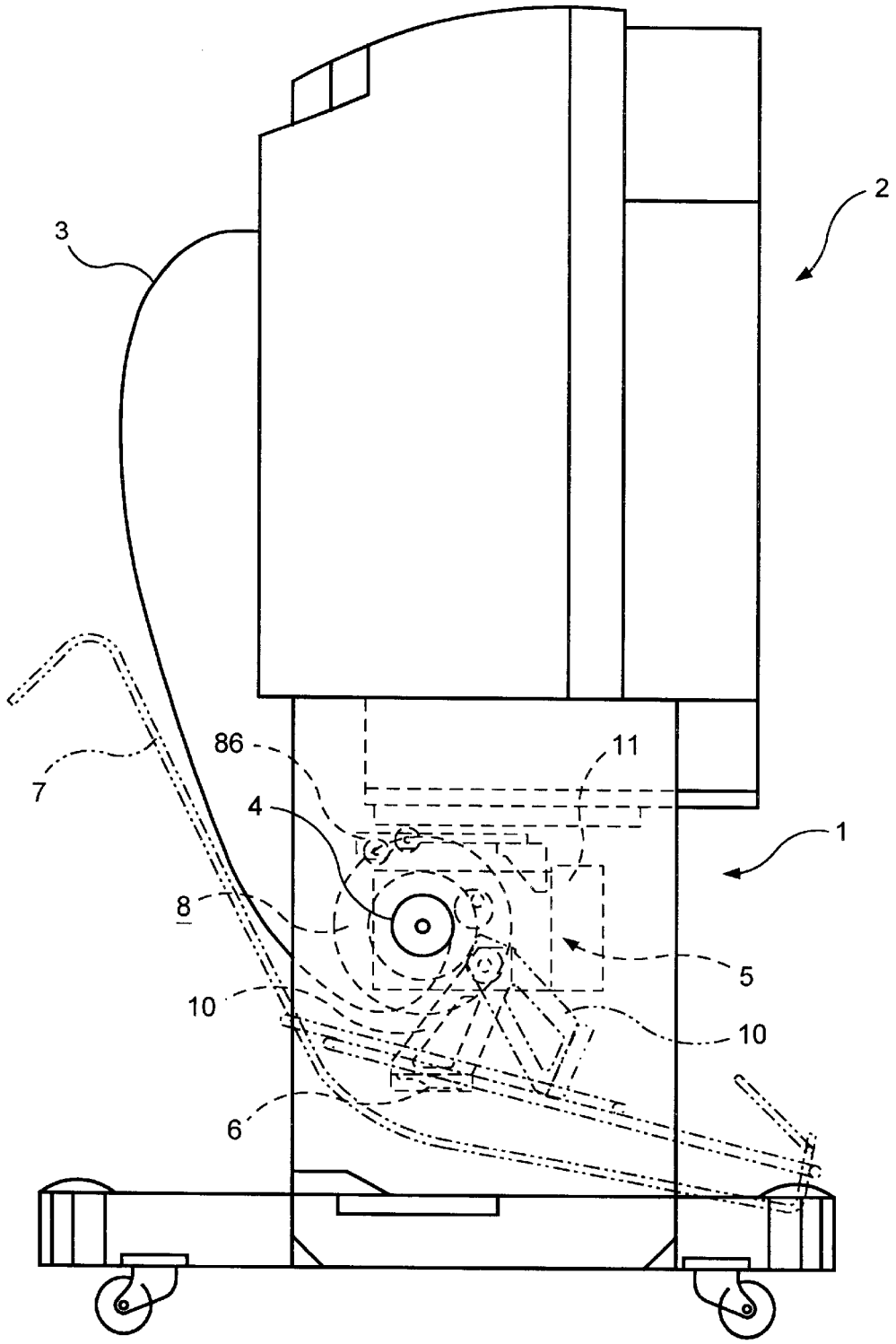
FIG. 1 is a side view of an entire printer in which a winding device of the present invention is used.

The configuration of the present invention is described in detail based on an embodiment illustrated in the drawings. FIGS. 1 through 25 illustrate an embodiment in which a winding device 1 of the present invention is used in a printer 2. The printer 2 is a large-scale full color printer 2 of ink jet type or electrostatic recording type, and a drawing medium 3 thereof is, for example, a roll paper wound on a pipe-like paper core made of cardboard as the winding core 4.

Figure 2:
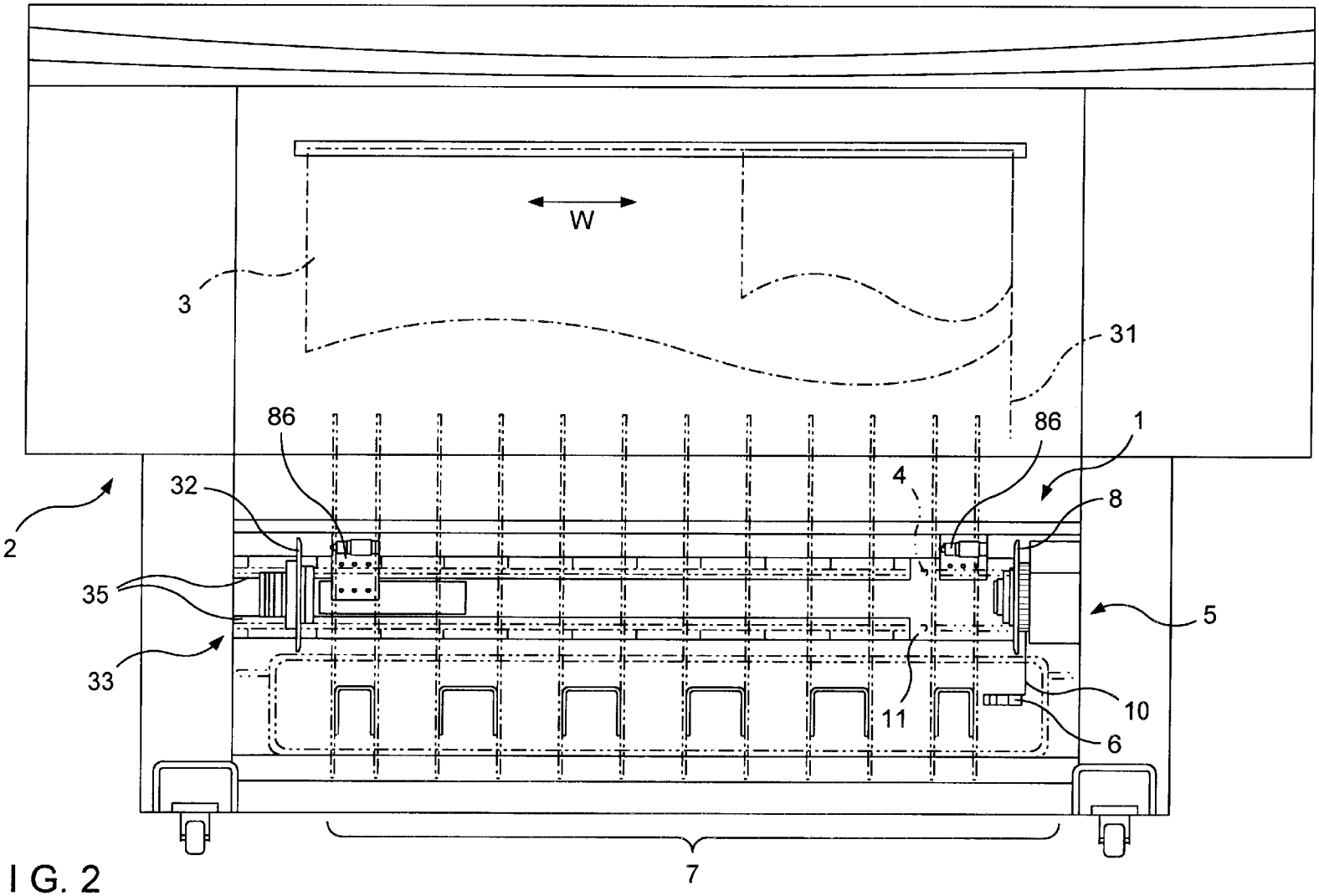
FIG. 2 is a front view of the entire printer in which the winding device is used.
Figure 3:
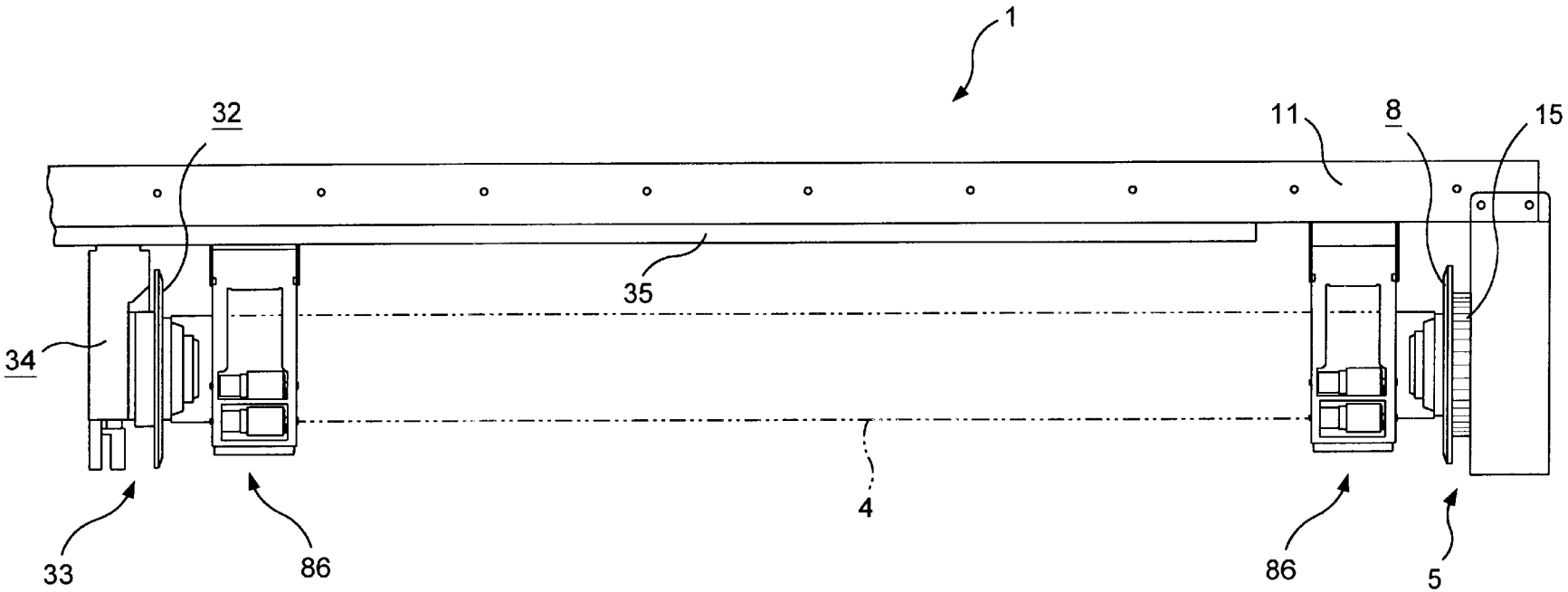
FIG. 3 is a plan view of the winding device.

As illustrated in FIGS. 1 through 3, the winding device 1 comprises a winding mechanism 5 and a looseness-detecting sensor 6. The winding mechanism 5 winds the medium 4 output by the printer 2 on the winding core 4. The looseness-detecting sensor 6 detects looseness of the medium 3 and actuates the winding mechanism 5 upon detection. The looseness-sensor 6 is also capable of receding from the moving area of the medium 3 when the sheet tray 7 is attached to the printer 2. For this reason, even when the sheet tray 7 is attached to the printer 2 for stocking up the cut medium 3, the medium 3 is prevented from interrupting the looseness-detecting sensor 6. There is no need to detach/attach a whole or part of the winding device 1 even when the sheet tray 7 is attached/detached.

Used as the winding core 4 is a paper tube made of cardboard, which is the same kind as that used for a blank medium 3 to be set in the printer. The winding core 4 is not limited to such a paper tube, but it is understood that the core may be a tube exclusively used for this purpose.

In this embodiment, the looseness-detecting sensor 6 is attached to the winding mechanism 5 by a sensor arm assembly 10, as illustrated in FIGS. 4 through 8. The winding mechanism 5 has a pair of winding core holding mechanisms 8 and 32 that support the winding core 4 by holding both ends of the core 4, a motor mechanism 9 that drives at least one of the winding core holding mechanisms 8, 32 (for example, the winding core holding mechanism 8 on the right side in FIG. 2 here) as the looseness-detecting sensor 6 detects looseness of the medium 3, and spool supporting board 12 and spool reinforcing board 13 that support and fix the winding core holding mechanism 8, motor mechanism 9, and sensor arm assembly 10 on the stay 11 of the printer 2.

The motor mechanism 9 has a built-in decelerating gear train. A gear portion 15 is formed around an outer periphery of a boss portion 14 of the winding core holding mechanism 8. A pinion 16 of the motor mechanism 9 is meshed with the gear portion 15 of the winding core holding mechanism 8. Note that a code 17 in FIGS. 4 and 6 indicates a cover.

The sensor arm assembly 10 includes a sensor arm 18 that supports the looseness-detecting sensor 6 to be capable of swinging, an arm rotary shaft 19 that rotatably supports the sensor arm 18 with respect to the winding mechanism 5 and rotates together with the sensor arm 18, a friction plate 20 united with the sensor arm 18 and arm rotary shaft 19, a clutch gear 21 that meshes with the gear portion 15 of the winding core holding mechanism 8 and is in contact with the friction plate 20, a spring 22 composed of a compressed coil spring that presses the clutch gear 21 onto the friction plate 20, and a spring basket 23 that supports one end of the spring 22, the other end of which faces the clutch gear 21.

The arm rotary shaft 19 passes through a substantially U-shaped supporting portion 24 formed at the upper end of the sensor arm 18 and both ends thereof are fixed by E-rings 25. When the arm rotary shaft 19 is inserted into a supporting portion 24 of the sensor arm 18, the friction plate 20, clutch gear 21, spring 22, spring basket 23, and spacer 26 are installed inside the supporting portion 24 in this order. When the spring 22 is installed, it is compressed. The clutch gear 21 is pressed by the force exerted by the spring 22 onto the friction plate 20. The arm rotary shaft 19 and friction plate 20 are secured to the sensor arm 18 with a D-cut fitting, etc. so that they rotate together with the sensor arm 18 as a single unit. In this embodiment, the arm rotary shaft 19 is formed like a tube. A cord 27 from the looseness-detecting sensor 6 passes through the inside of the arm rotary shaft 19.

One end of the arm rotary shaft 19 projecting from the sensor arm assembly 10 is rotatably fitted into a hole in the spool supporting plate 12 via the spacer 26. The other end of the arm rotary shaft 19 projecting from the sensor arm assembly 10 is rotatably fitted into a hole in the spool reinforcing board 13 via the spacer 26. Then, the spool reinforcing plate 13 is screwed onto the spool supporting board 12 to sandwich the sensor arm assembly 10.

The sensor arm assembly 10 is rotatable about the arm rotary shaft 19 with respect to the spool reinforcing board 13 and spool supporting board 12. At that time, the arm rotary shaft 19, sensor arm 18, and friction plate 20 rotate together as a single unit within a limited range that will be described below.

The looseness-detecting sensor 6 is a mechanical contact-type sensor that performs detection with the contact of the medium 3 and is united with the winding mechanism 5. Since the sensor is of a contact-type, the detection is kept accurate, while it may be degraded with an optical sensor because the optical axis of the sensor is transgressed due to contamination or shifted after installation. Thus, reliability of detection can be improved. Because the looseness-detecting sensor 6 is united with the winding mechanism 5, there is no need to wire the sensor with the winding mechanism 5, which is normally required when the optical sensor is used in the printer 2. This simplifies the operation of mounting the sensor in the printer 2.

Figure 4:
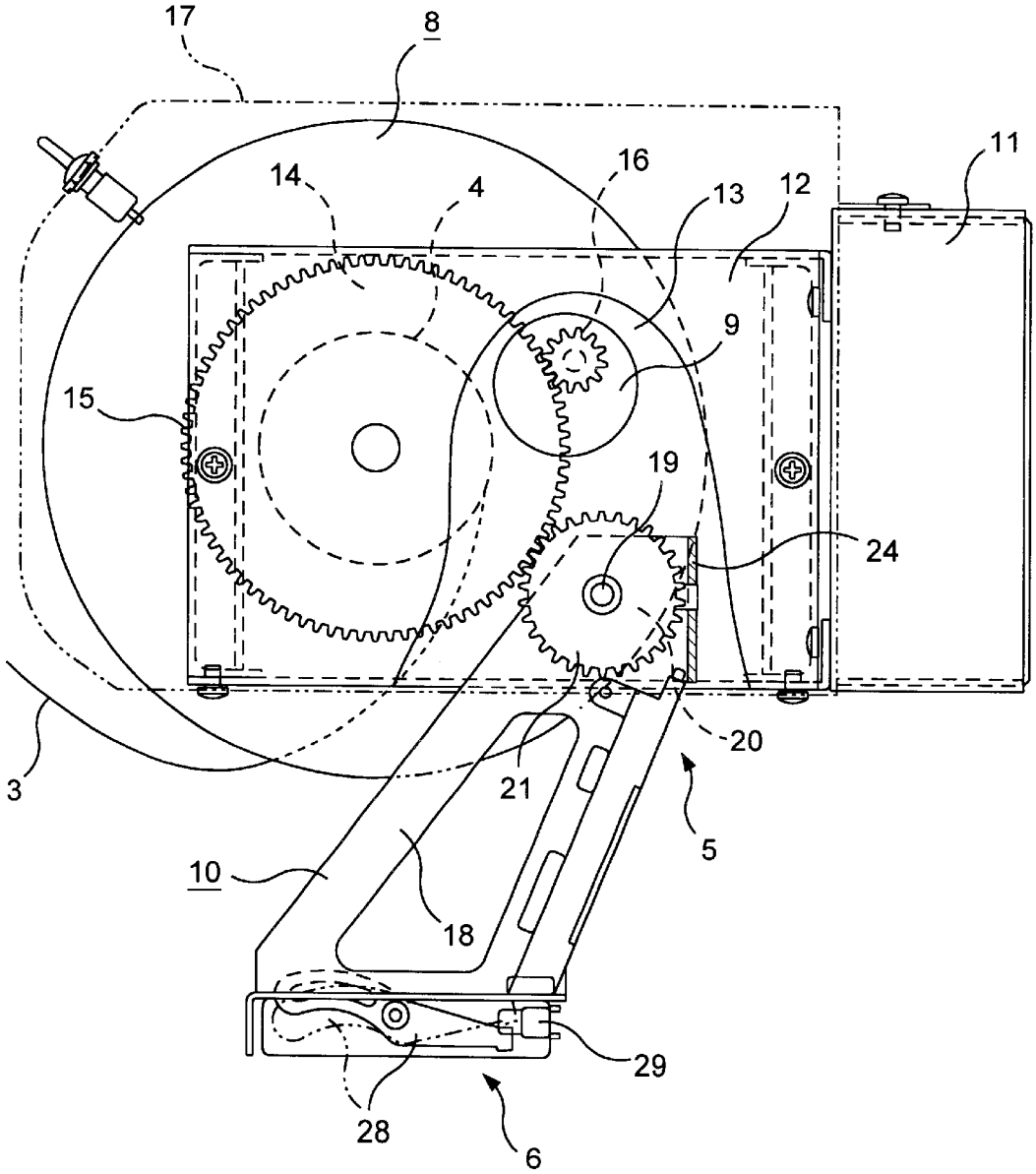
FIG. 4 is a side view of the winding device when a looseness-detecting sensor is at the detecting position.
Figure 5:
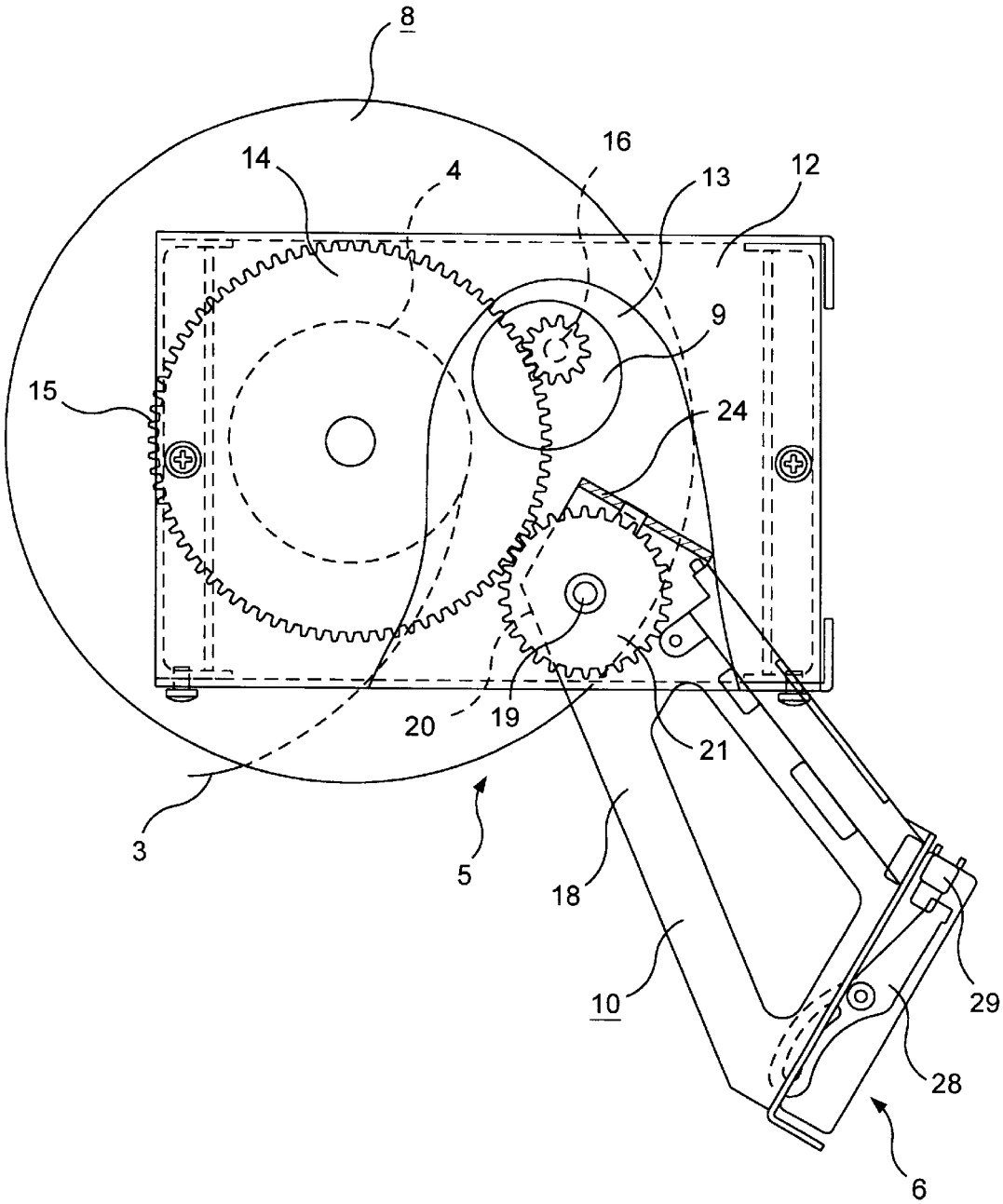
FIG. 5 is a side view of the winding device when the looseness-detecting sensor is at the receding position.
Figure 6:
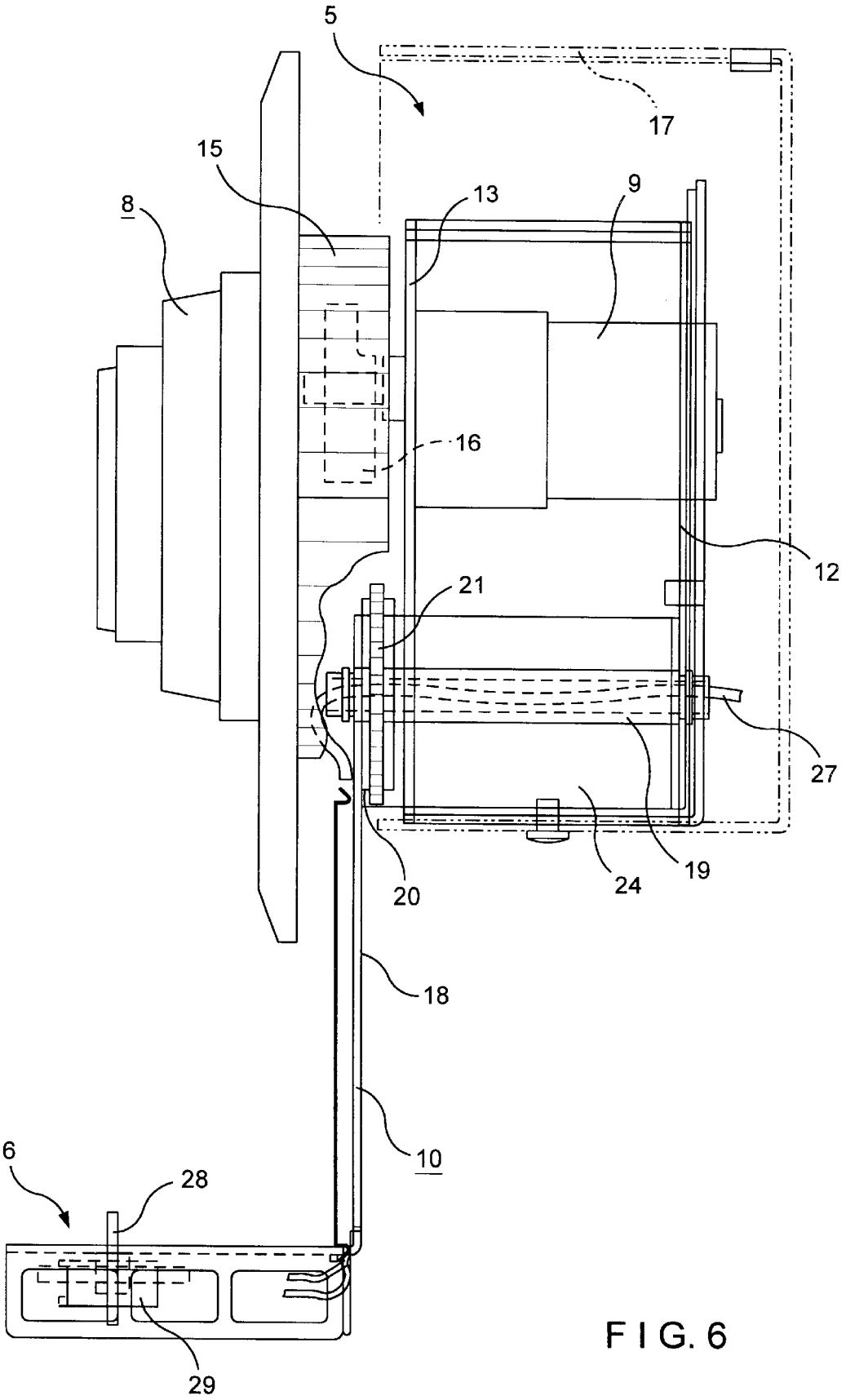
FIG. 6 is a front view of the winding device when the looseness-detecting sensor is at the detecting position.
Figure 7:
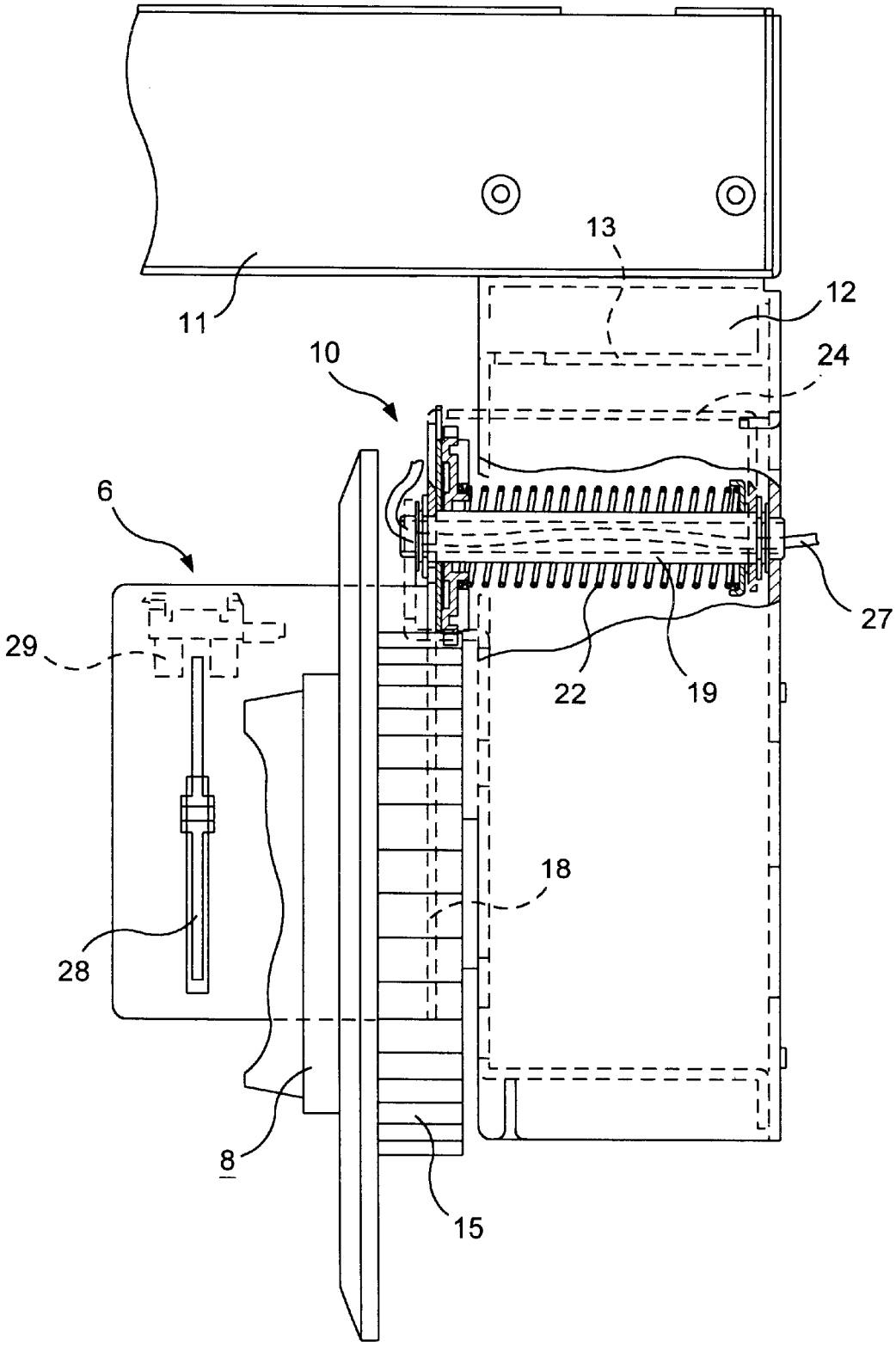
FIG. 7 is a plan view of the winding device when the looseness-detecting sensor is at the detecting position.
Figure 8:
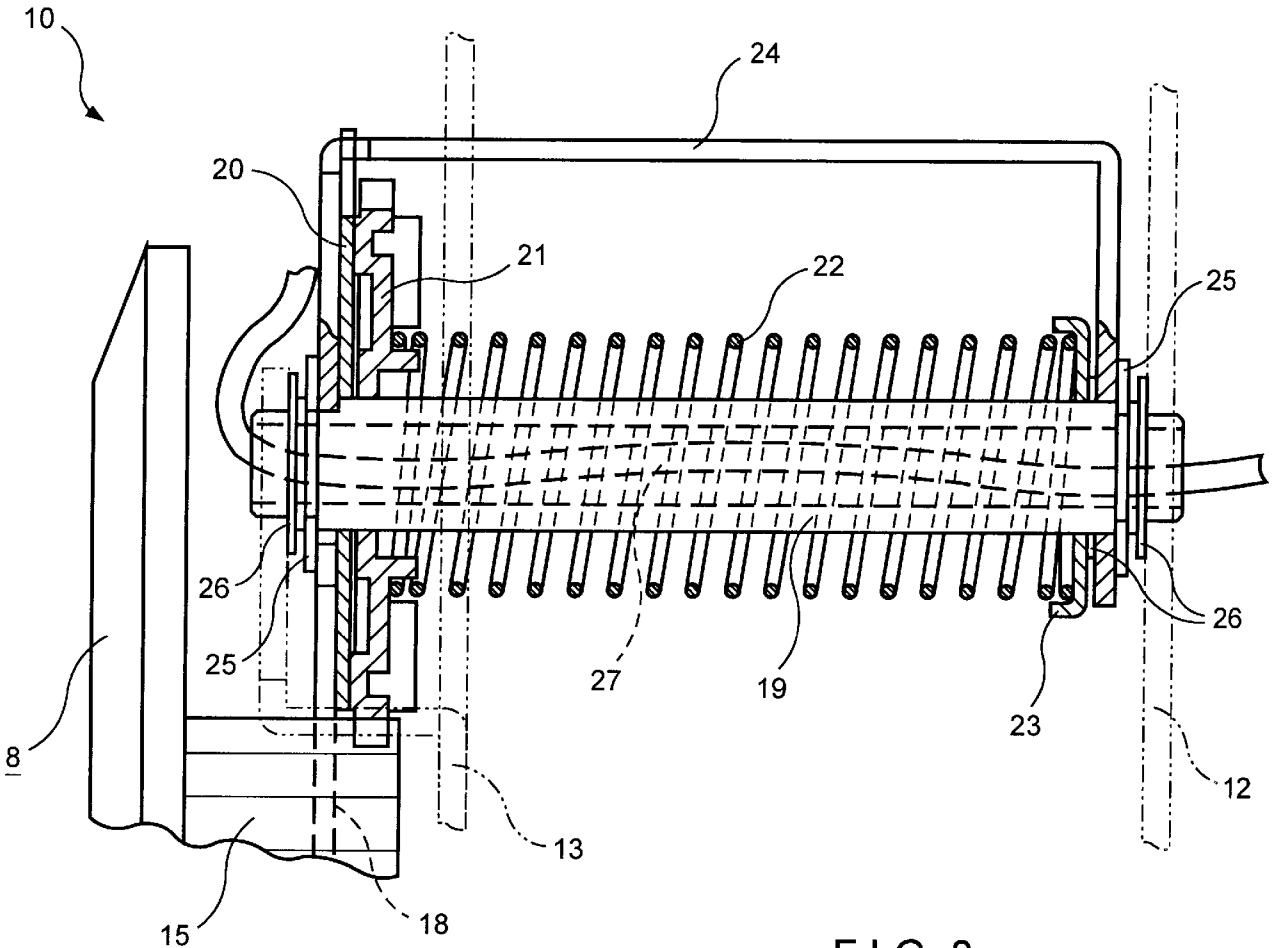
FIG. 8 is a front view of a major portion of a sensor arm assembly.
Figure 9:
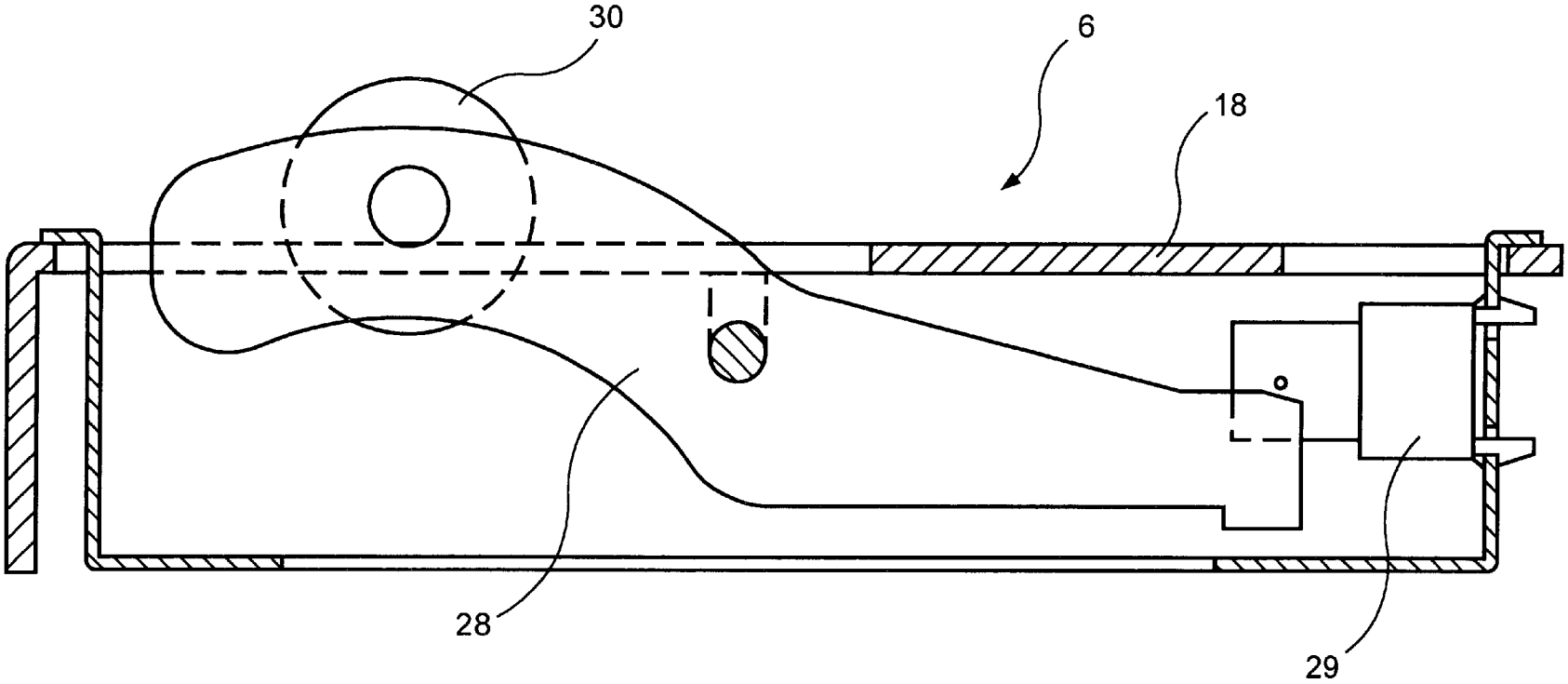
FIG. 9 is a side view of a contact lever in another embodiment.
Figure 10:
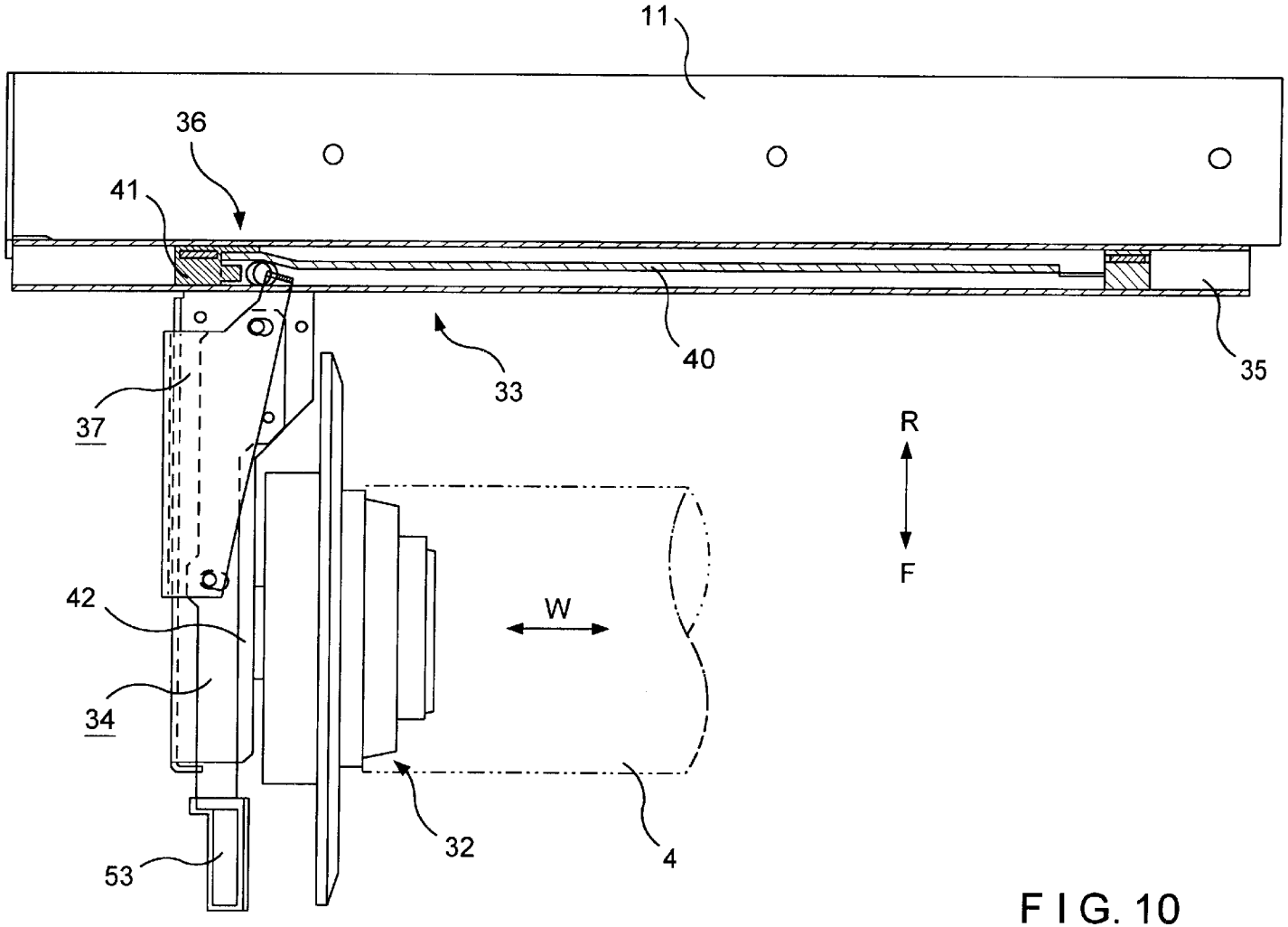
FIG. 10 is a plan view of a roll medium holding device.

The looseness-detecting sensor 6 has a contact lever 28, which is attached to the bottom portion of the sensor arm 18 to be capable of swinging, and a photo sensor 29 for detecting the swing of the contact lever 28. The contact lever 28 is swung by the contact of the medium 3, and this movement is detected by the photo sensor 29. The contact lever 28 is capable of swinging with a very small force. In other words, the contact lever 28 is normally in a raised position (shown by a solid line in FIG. 4), and the weight thereof is well-balanced so that the sensor 6 swings down to a lower position (shown by the double-dotted line in the same figure) with a very small force. With this, the lever 28 is protected from bending or damage when the medium 3 comes into contact therewith. Note that the contact portion of the contact lever 28 with the medium 3 can be made in a circular arc shape as shown in FIGS. 4 and 5, or a rotatable roller 30 may be attached to the sensor as shown in FIG. 9 to reduce contact resistance.

In the printer 2 of this embodiment, a right side edge 31 of the output medium 3 in FIG. 2 is used as a reference edge 31. The end of the winding core 4, which is held by the winding core holding mechanism of the winding device 1 on the right side (hereinafter denoted as a fixed-side winding core holding mechanism), is aligned with the reference edge 31. On the other hand, the core holding mechanism 32 on the left side in FIG. 2 (hereinafter denoted as a sliding-side core holding mechanism) is supported capable of sliding by a roll medium holding device 33. The sliding-side core holding mechanism 32 is slid for attaching/detaching the winding core 4.

As illustrated in FIGS. 10 through 15, the roll medium holding device 33 includes a slider portion 34 fixed to the core holding mechanism 32 and a guide portion 35 supporting the slider portion 34 to be capable of sliding along the width direction W of the medium 3. The roll medium holding device 33 also includes a locking means 36, which locks the slider portion 34 from sliding in the direction moving away from the winding core 4, and an unlocking means 37 which can unlock the locking means 36. The sliding portion 34 is pushed and slid toward the winding core 4 for attaching the winding core 4. Since the locking means 36 is not operational at that time, the slider portion 34 can be slid easily. After the winding core holding mechanism 32 contacts and holds the winding core 4, the pushing effect on the slider portion 34 is stopped. At that time, the slider portion 34 never moves in the direction away from the winding core 4 because of the effect of the locking means 36, maintaining a good holding condition of the winding core 4. Accordingly the winding core 4 can be installed by a one-touch operation. To remove the winding core 4, the unlocking means 37 is operated to slide the slider portion 34 and winding core holding mechanism 32. Accordingly the winding core 4 can be removed by an easy operation almost like a one-touch operation.

Figure 12:
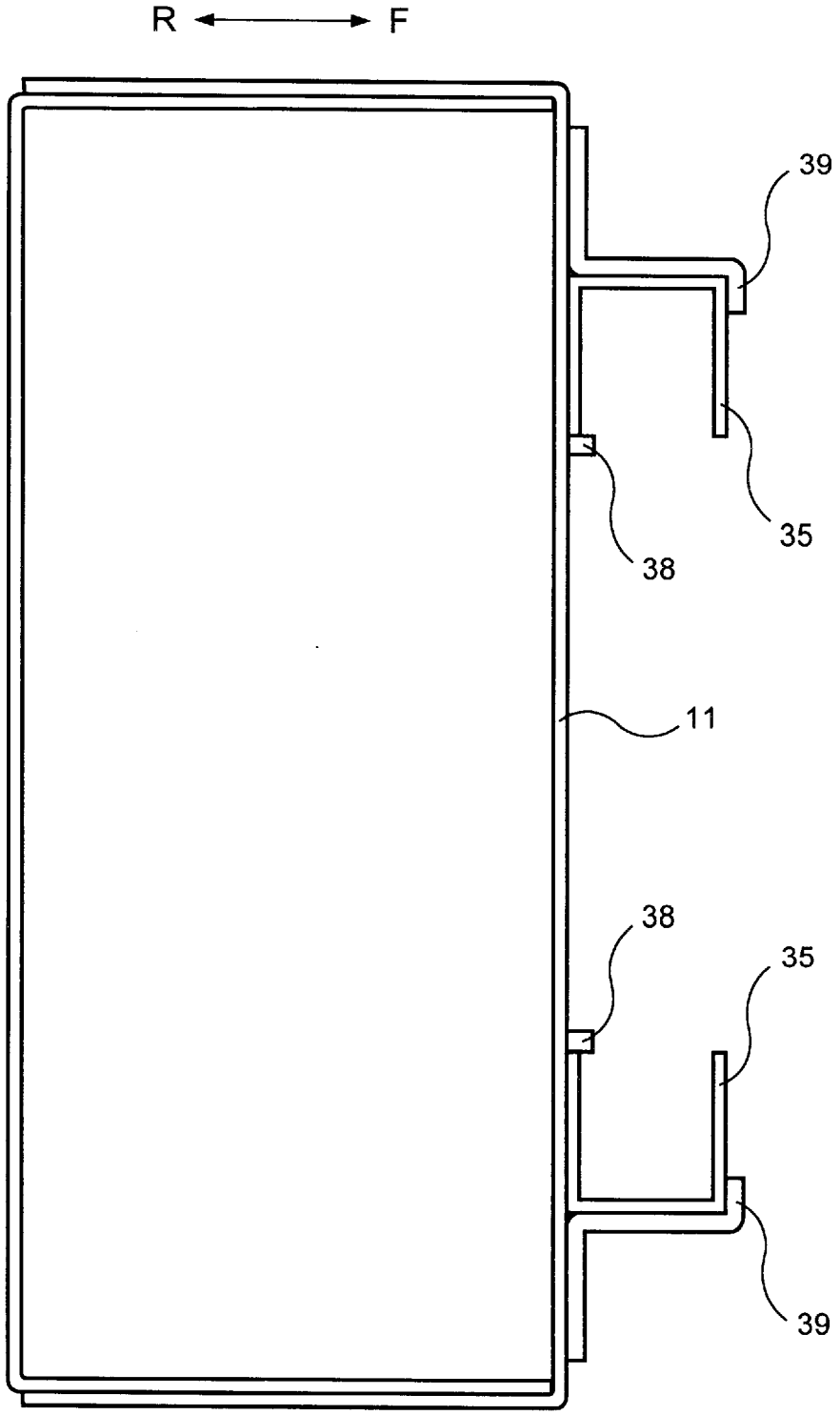
FIG. 12 is a side view of a guiding portion.
Figure 13:
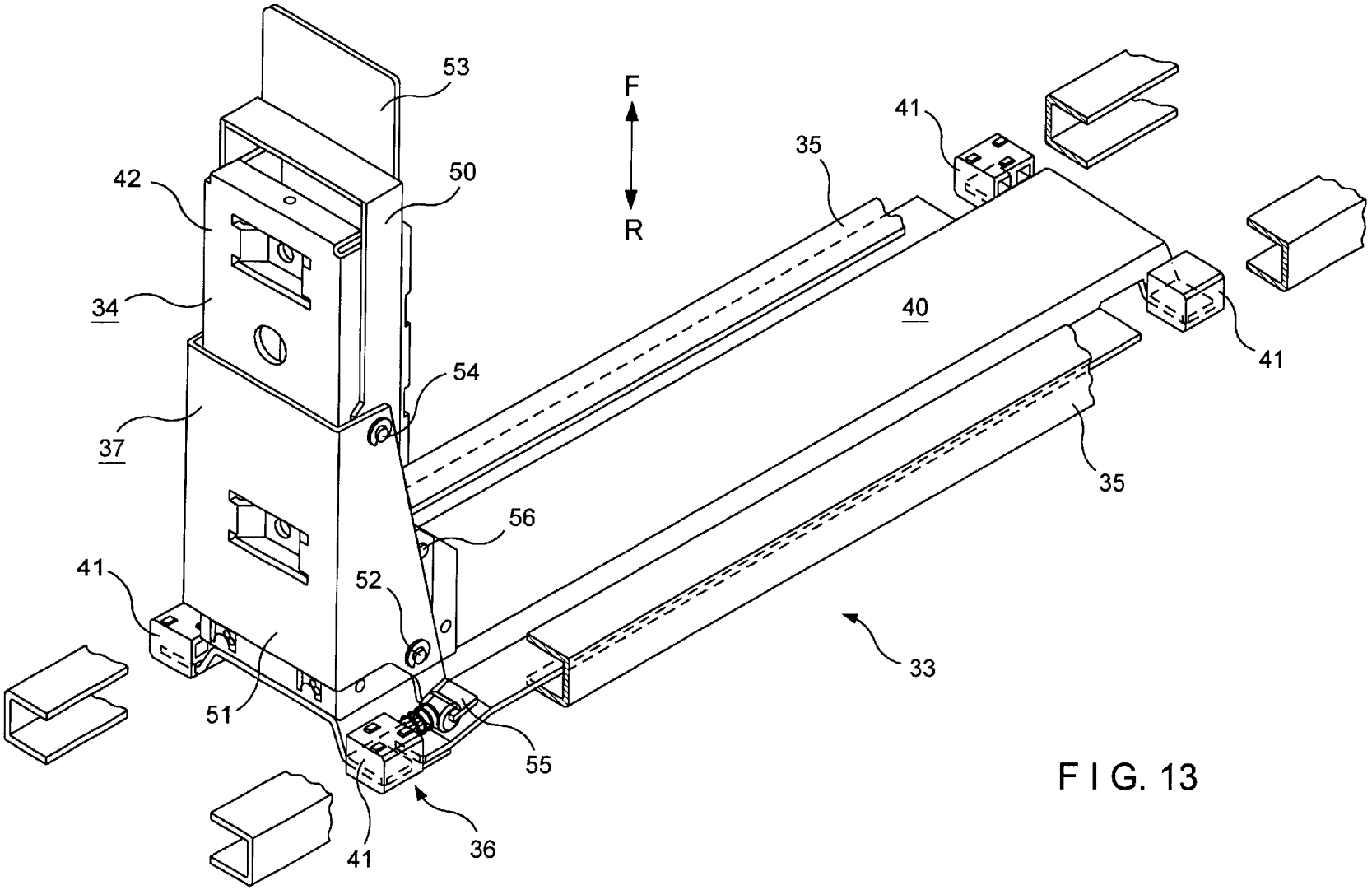
FIG. 13 is a perspective view of the major portion of the roll medium holding device.

The guiding portions 35 are composed of guiding rails extending along the stay 11 formed in the width direction W of the printer 2 from the left end to the vicinity of the right end of the winding device 1. The guiding portions 35 are channel components, each of which has a substantially U-shaped cross-section; they are arranged at the top and bottom so that the open ends of substantial U-shape face each other. As illustrated in FIG. 12, each of the guiding portions 35 is positioned by hitting against a positioning projection 38 which is formed at the stay 11 in the horizontal direction. Each guiding portion 35 is positioned in the above manner, and then held in a guiding rail securing plate 39 and tightly secured to the stay 11. In this embodiment, the guiding portion is tightly secured by a screw.

Figure 14:
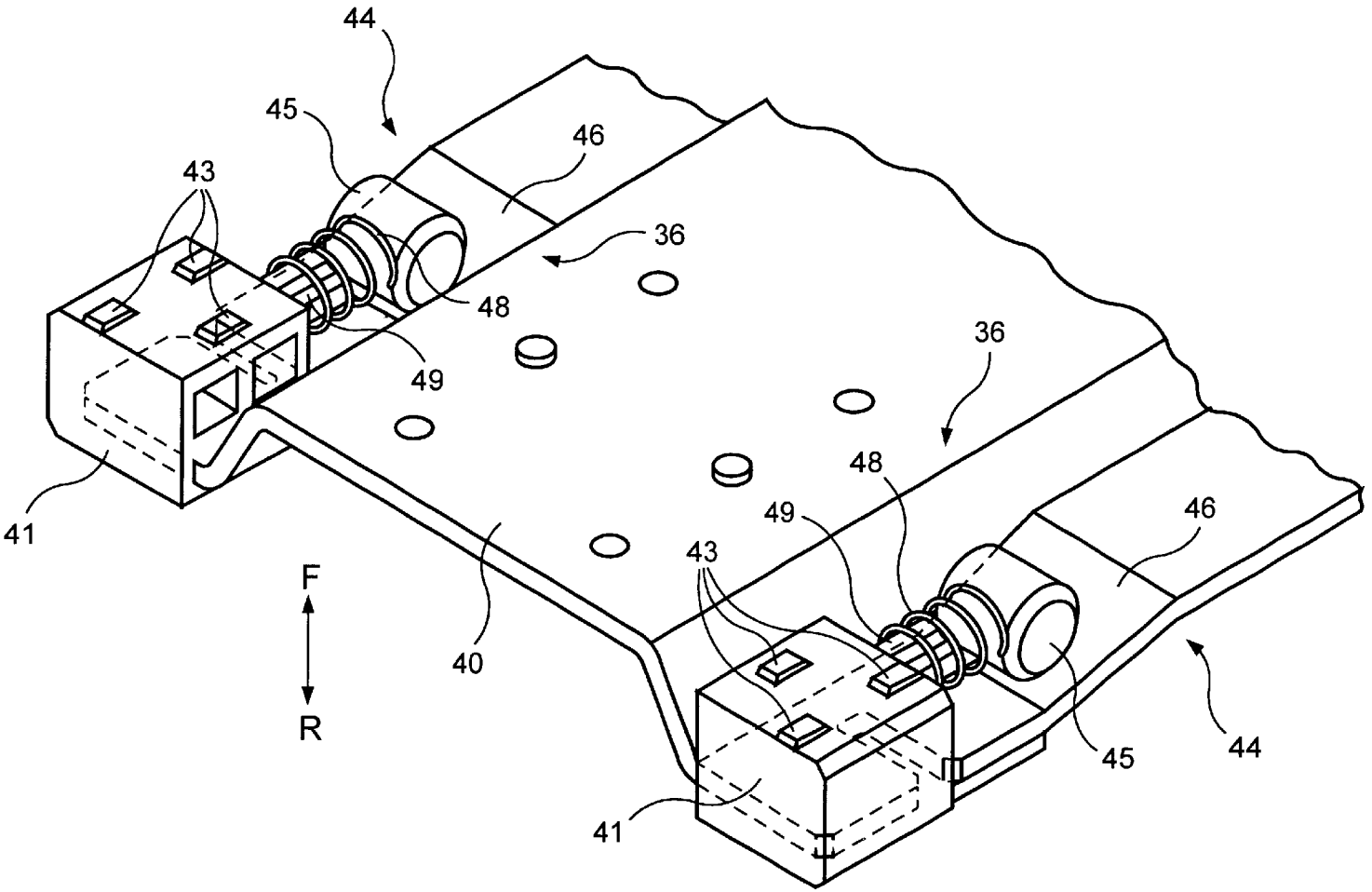
FIG. 14 is a perspective view of a locking means.

The slider portion 34 includes a slide plate 40, sliding blocks 41 attached at the four corners of the slide plate 40, and a supporting stay 42 for an operator to perform a sliding operation. The sliding blocks 41 are fitted at the four corners of the slide plate 40, as illustrated in FIG. 14, etc. Contact points 43 are formed on the front F surfaces and back R surfaces of the sliding blocks 41 to make contact with inner surfaces of the guiding portions 35. Consequently the contact area of the guiding portions 35 with the sliding blocks 41 can be reduced to a minimum to reduce resistance when sliding. One of the four sliding blocks 41 is not formed with the contact points 43. Therefore, even if the guiding portions 35 are distorted due to errors in dimensions or assembly, the slider portion 34 can be slid easily.

Figure 16:
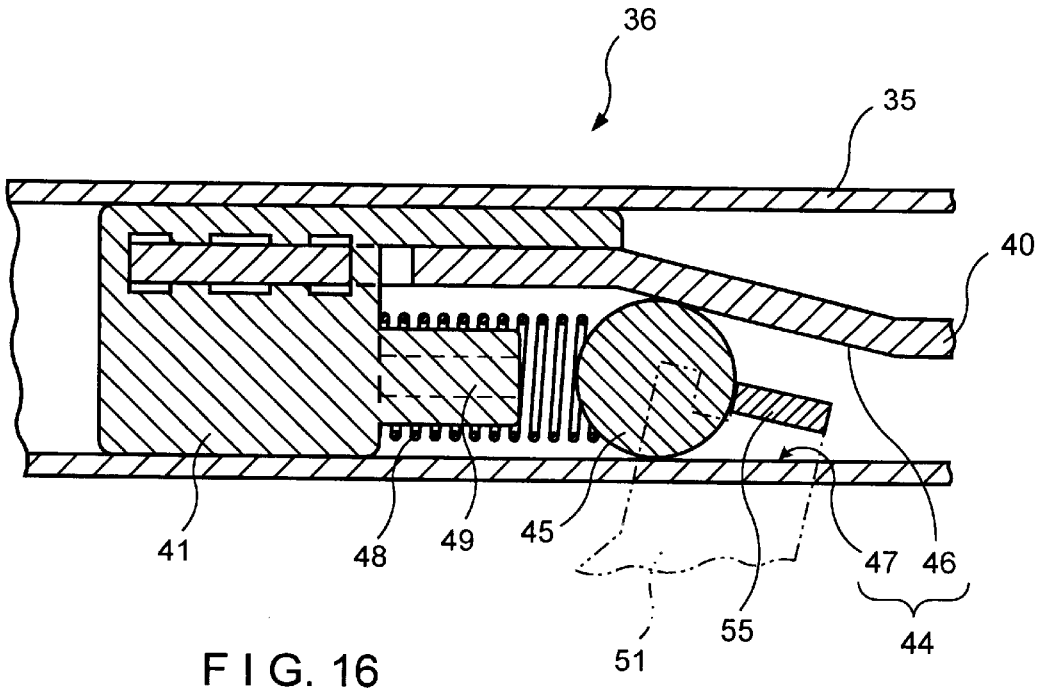
FIG. 16 is a plan view of the locking means at work.
Figure 17:
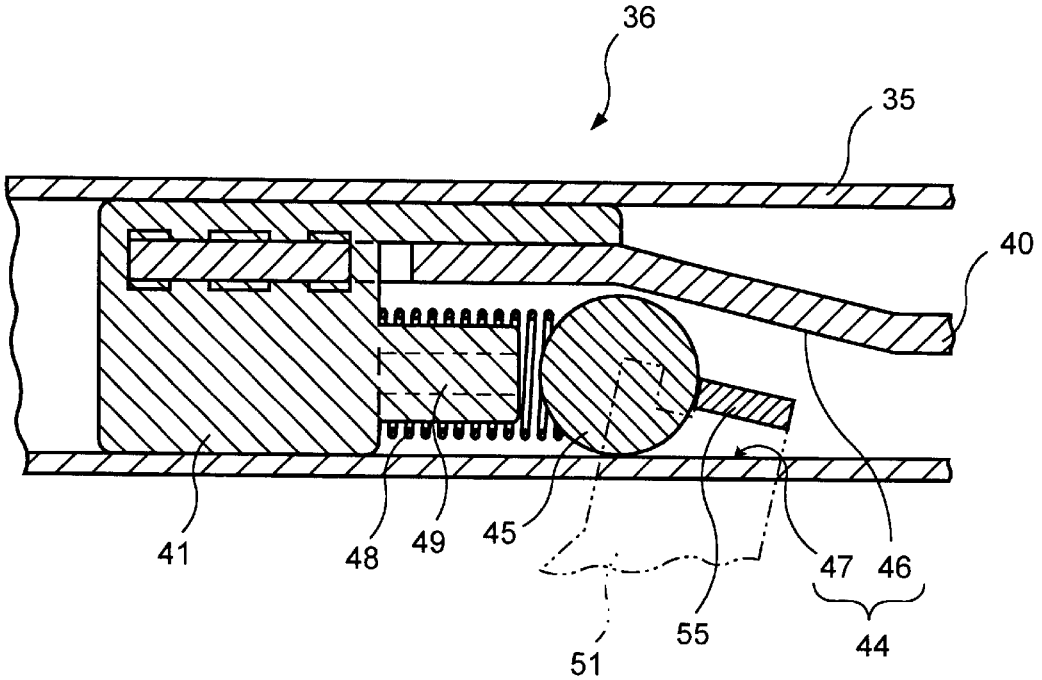
FIG. 17 is a plan view of the condition under which the locking means is unlocked.

The locking means 36 includes wedge-shaped facing planes 44 provided between the slider portion 34 and guiding portions 35, and a stopper member 45 that creeps in and widens the space between the facing planes 44 to lock the relative movement of the slider portion 34 and guiding portions 35. Consequently the locking means 36 can be configured with a simple mechanism, thus reducing the cost for the roll medium holding device 33. In this embodiment, as illustrated in FIGS. 16 and 17, the facing planes 44 consist of an inclined surface 46 constructed inside the guiding portion 35 of the slide plate 40 and an inner surface 47 of the guiding portion 35 that is opposed to the inclined surface 46.

The stopper member 45 is composed of a metallic cylindrical roller, for example. Also, a spring 48 composed of a compressed coil spring is provided between the sliding block 41 and the stopper member 45 to push the stopper member 45 into the space between the facing planes 44. The spring 48 is supported by a spring supporting projection 49 on the sliding block 41.

The core 4 is installed in the following manner. As the slider portion 34 is pushed toward the core 4, the stopper member 45 escapes from the space between the facing planes 44. Therefore, the slide plate 40 is not locked and can be slid easily. As the sliding-side winding core holding mechanism 32 abuts to the core 4 and holds it, the pressing of the slider portion 34 is stopped. Since the spring 48 has pushed the stopper member 45 into the space between the facing planes 44, even when the operator's hand is released or the slider portion 34 is pushed in the direction away from the core 4 as illustrated in FIG. 16, the stopper member 45 moves to creep in the space between the facing planes 44. Consequently the sliding plate 40 is locked onto the guiding portions 35. Thus, both ends of the core 4 are held by the winding core holding mechanisms 8 and 32 on the left and right sides, which maintains the holding condition.

Figure 11:
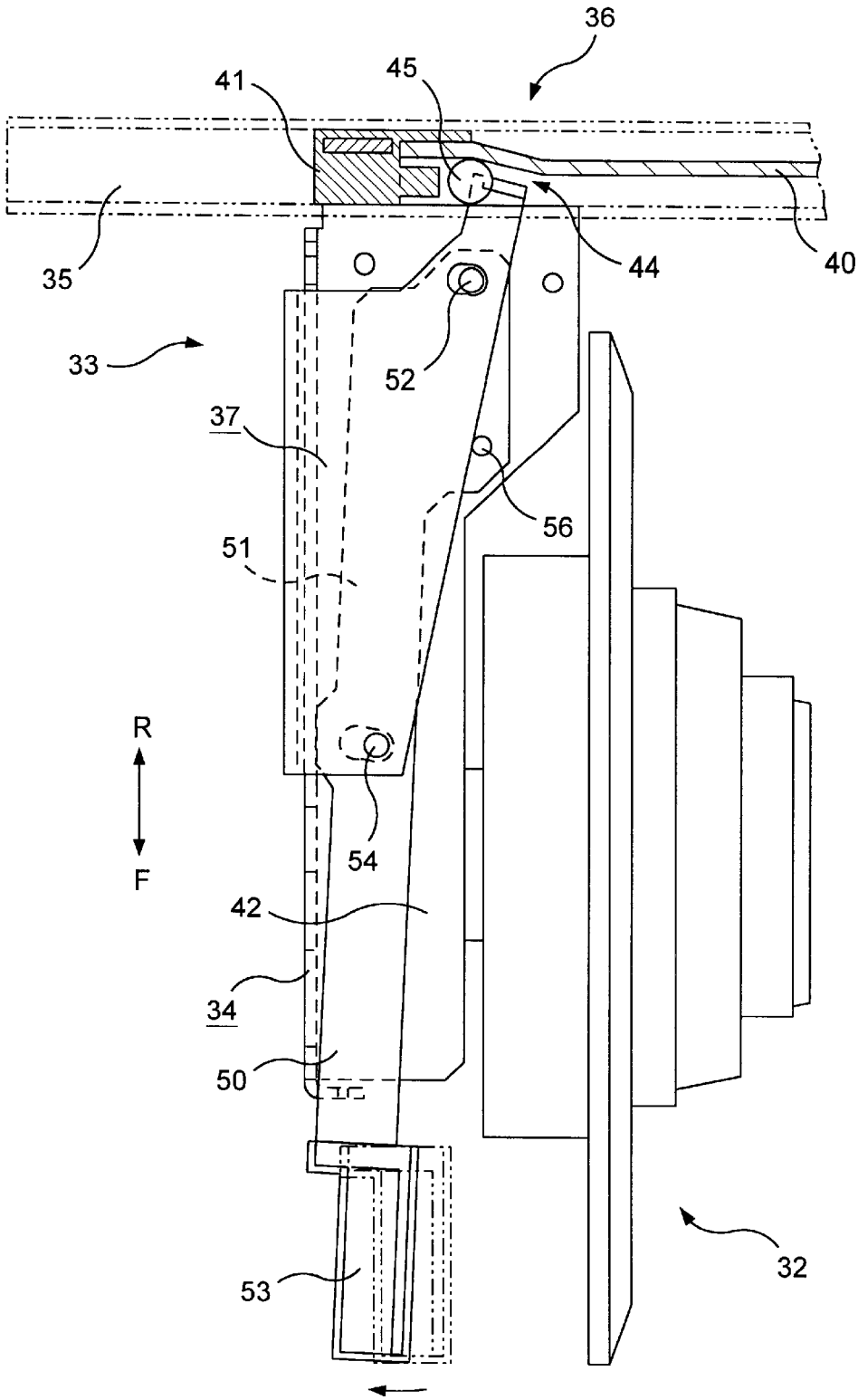
FIG. 11 is a plan view of a major portion of the roll medium holding device.
Figure 15:
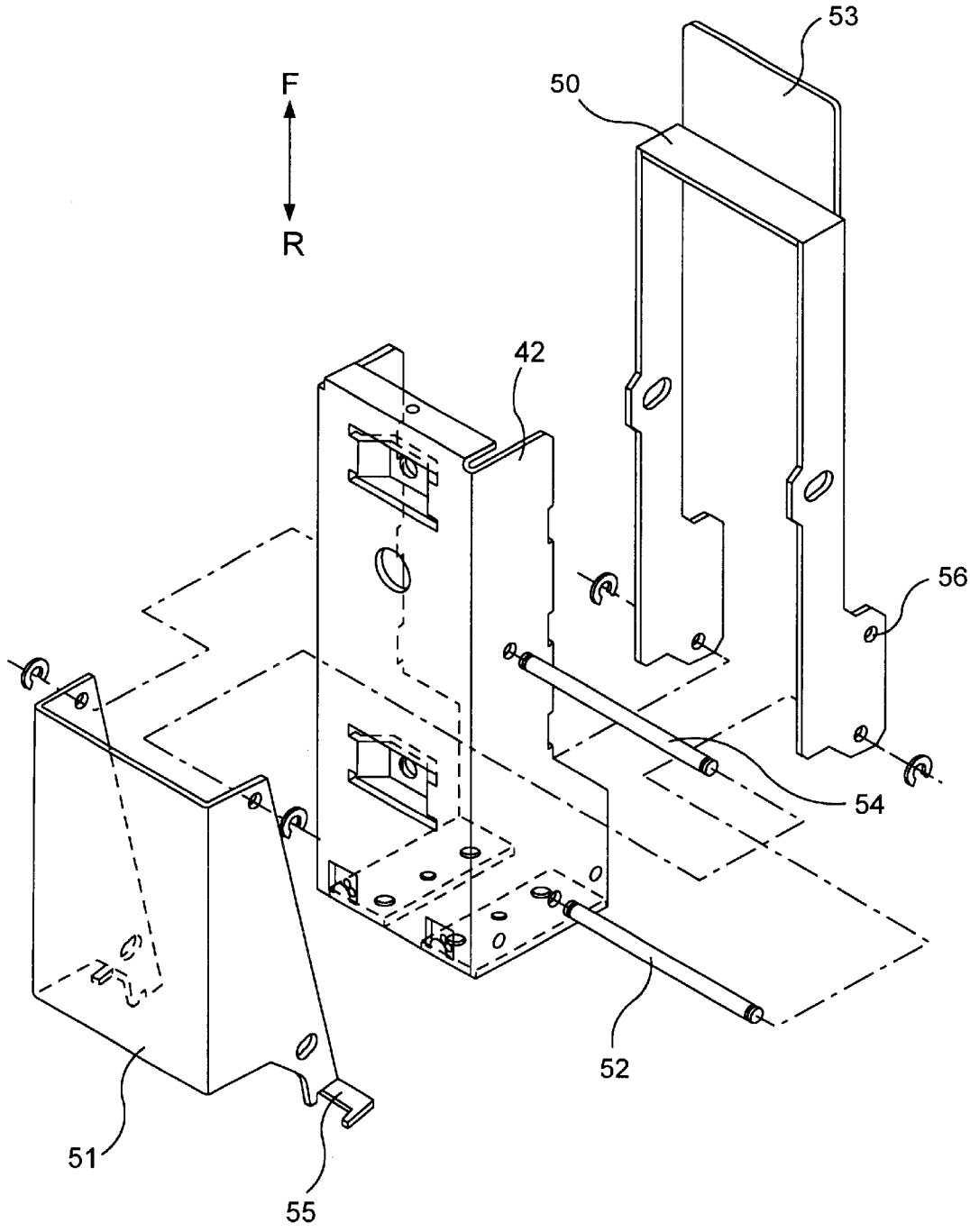
FIG. 15 is a dissembled view of an unlocking means.

The unlocking means 37 includes operation lever 50 and unlocking lever 51 which are attached to the supporting stay 42 to be capable of swinging, as illustrated in FIG. 15. The operation lever 50 is supported at the portion of the supporting stay 42 on the sliding plate 40 side, i.e., on the rear side R by a rotary shaft 52, and also has an operating portion 53 projecting to the front side F. The unlocking lever 51 is supported at the center of the supporting stay 42 by a rotary shaft 54, and has a pressing portion 55 that presses the stopper member 45 in the direction to move off the space between the facing planes 44 by the swing thereof. The operation lever 50 is formed with a lever pushing protrusion 56 that swings the unlocking lever 51 when the lever 50 is rotated about the rotary shaft 52. As illustrated in FIG. 11, as the operating portion 53 of the operation lever 50 is pushed in the arrow direction, the operation lever 50 is swung, and the lever pushing protrusion 56 swings the unlocking lever 51. Then, as illustrated in FIG. 17, as the pressing portion 55 moves, the stopper member 45 out of the space between the facing planes 44, the slider portion 34 is unlocked.

In this embodiment, as the operation lever 50 is moved in the direction to which the slider portion 34 recedes (in the arrow direction in FIG. 11), the unlocking lever 51 moves the stopper member 45 out of the space between the facing planes 44. In other words, the operation direction of the unlocking means 37 is same as the direction in which the guiding portion 35 is receded. For this reason, the unlocking means 37 is operated simultaneously with the receding operation of the slider portion 34 by a one-touch operation. This improves operability.

As illustrated in FIGS. 18 through 21, at least one of the winding core holding mechanisms 8, 32, which hold the winding core 4, has a base 57, a larger diameter reference portion 58, a tapered larger diameter centering portion 59, a smaller diameter reference portion 60, and a tapered smaller diameter centering portion 61. The base 57 is fixed in the axial direction of the winding core 4. The larger diameter reference portion 58 is capable of axially moving in and out of the base 57 and makes contact with an end face 4*a* of a winding core 4' of larger diameter. The centering portion 59 is capable of axially moving in and out of the larger diameter reference portion 58 and fits to the core 4' of larger diameter. The smaller diameter reference portion 60 is capable of axially moving in and out of the base 57 and makes contact with an end face 4*b* of a winding core 4" of smaller diameter. The smaller diameter centering portion 61 is capable of axially appearing with respect to the smaller diameter reference portion 60 and fits to the core 4" of smaller diameter.

To hold the larger diameter core 4', the larger diameter centering portion 59 centers the core 4' as falling into the larger diameter reference portion 58 which in turn falls into the base 57. The end face 4*a* of the larger diameter core 4' is positioned at a predetermined reference position 62 with respect to the base 57. To hold the smaller diameter core 4", the smaller diameter centering portion 61 centers the core 4" as falling into the smaller diameter reference portion 60. Then, the smaller diameter reference portion 60, larger diameter reference portion 58, and larger diameter centering portion 59 fall into the base 57 to position the end face 4*b* of the smaller diameter core 4" at the reference position 62.

For this reason, both the larger diameter core 4' of 3 inches of inner diameter and the smaller diameter core 4" of 2 inches of inner diameter can be held. Thus, two kinds of winding cores 4' and 4" can be supported without changing components. This improves operability and eliminates complicated management of components. Also, the reference position 62 for the core 4 can be determined regardless of the size of the mounted core 4. Therefore, when the core holding mechanism is used in the winding device 1 or in the printer 2, the reference edge 31 of the medium 3 output from the printer 2 can be easily aligned with the reference position 62 of the winding core 4. Consequently the oblique winding of the medium 3, which is normally caused due to disagreement between the reference edge 31 and reference position 62, can be prevented.

In this embodiment, the winding core holding mechanisms 8 and 32 on left and right are configured the same except that the gear portion 15 is provided only in the core holding mechanism 8 and bearing 65 and washer 64 are provided only in the core holding mechanism 32. As a result, the core holding mechanisms 8 and 32 on the left and right sides share most of the components, and thus the cost of the components can be reduced. Although both the core holding mechanisms 8 and 32 on the left and right sides are used to determine the reference position 62 in this embodiment, if at least fixed-side winding core holding mechanism 8 can determine the reference position 62, the position 62 can be aligned with the reference edge 31 of the medium 3. In this case, the sliding-side winding core holding mechanism 32 is simply configured to have a tapered centering portion. This simplifies the configuration of the sliding-side core holding mechanism 32.

Each of the core holding mechanisms 8 and 32 of this embodiment further has a flange shaft 63 fixed to the supporting stay 42 or spool supporting plate 12. The flange shaft 63 passes through the washer 64, bearing 65, base 57, larger diameter reference portion 58, larger spring 66, smaller spring 67, larger diameter centering portion 59, smaller diameter reference portion 60, and smaller diameter centering portion 61 in this order; the smaller diameter centering portion 61 is stopped from coming off by E-ring 68. The members other than the washer 64 and an inner ring of the bearing 65 rotate together with the core 4 held thereby. Since the bearing 65 is used in each of the core holding mechanisms 8 and 32, the rotation load on the members rotating together with the core 4 is reduced, and the core 4 held by those members is prevented from idle rotation.

The base 57 is formed with a flange 69 for protecting the side edges of the medium 3. The base 57 also has protrusion raising portions 70, axially extending escape grooves 71 cut adjacent to the protrusion raising portions 70, recess portions 72, and axially parallel guide grooves 73. The larger diameter reference portion 58 includes protrusions 74, which hit against the protrusion raising portions 70 of the base 57 or are guided to the escape grooves 71, nails 75 to be caught at the recess portions 72 of the base 57, and cam grooves 76. Although the larger diameter reference portion 58 is capable of sliding with respect to the base 57, the nails 75 on the larger diameter reference portion 58 are caught by the recess portions 72 of the base 57 to prevent the reference portion 58 from coming off from the base 57. The amount of the sliding of the larger diameter reference portion 58 in the direction to fall into the base 57 varies depending on the rotational angle of the larger diameter reference portion 58 with respect to the base 57. In other words, when the protrusions 74 on the larger diameter reference portion 58 contact the protrusion raising portions 70, the reference portion 58 can fall into the base no farther than that. On the other hand, when the larger diameter reference portion 58 is rotated and the protrusions 74 are guided to the escape grooves 71 of the base 57, the reference portion can further fall into the base. Note that, as understood in FIG. 19, the protrusion raising portion 70, escape groove 71, recess portion 72, guide groove 73, protrusion 74, nail 75, cam groove 76, cam protrusion 77, sliding protrusion 78, and bottom portion 83 are respectively formed at three positions, i.e., equally positioned by 120° around the corresponding circumferences in this embodiment.

Figure 20:
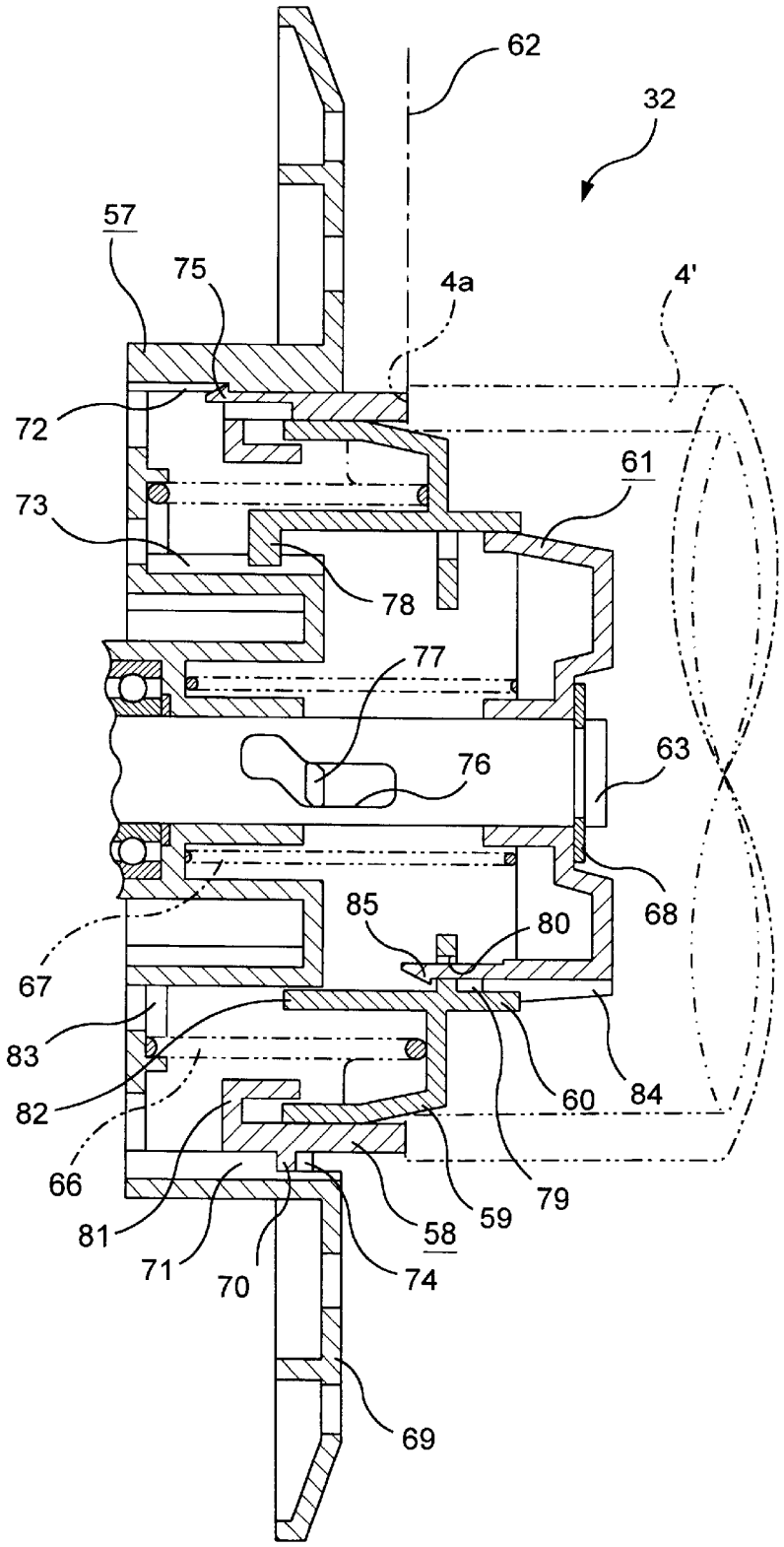
FIG. 20 is a plan view of a center cross-sectional view of the sliding-side core holding mechanism holding a winding core of larger diameter.

The protrusion raising portions 70 and protrusions 74 are positioned such that when the winding core 4' of larger diameter is made contact with and pushed into the larger diameter reference portion 58, the end face 4*a* of the core 4' is positioned a predetermined distance (7 mm, for example) away from the inner surface of the flange 69, as illustrated in FIG. 20. Consequently the flange 69 is separated from the winding core 4' by a predetermined distance, and the end face 4*a* of the core 4' can be positioned at the reference position 62. Further, because the flange 69 and core 4' are positioned with a predetermined distance from one another, the gap can be a relief for various situations such as the case that the medium 3 reference edge 31 and the reference position 62 are shifted from one another, the case that the medium 3 absorbs moisture during printing and the width dimension thereof expands, the case that there is a discrepancy between the length of the winding core on the supply side and that on the winding side although the normal dimensions are the same, and the case that there is a discrepancy between the length of the winding core on the supply side and the width of the medium 3. This provides a countermeasure to the cause that hinders winding. In this embodiment, although the distance between the flange 69 and winding core 4' is set 7 mm, it is not limited to this.

The smaller diameter reference portion 60 is formed integrally with the larger diameter centering portion 59. The smaller diameter reference portion 60 includes cam protrusions 77, slide protrusions 78, axially parallel guiding grooves 79, and engaging holes 80. The cam protrusions 77 are guided to the cam grooves 76 cut in the larger diameter reference portion 58, and the slide protrusions 78 are guided to the guiding grooves 73 cut in the base 57. With this configuration, the smaller diameter reference portion 60 is rotated by the cam mechanism 76 and 77 while sliding into the larger diameter reference portion 58. Further, the slide protrusions 78 on the smaller diameter reference portion 60 are engaged with and guided into the guide grooves 73 in the base 57. With this, the smaller diameter reference portion 60 is movable in the axial direction of the base 57, but locked in the rotational direction to rotate together with the base 57.

Figure 21:
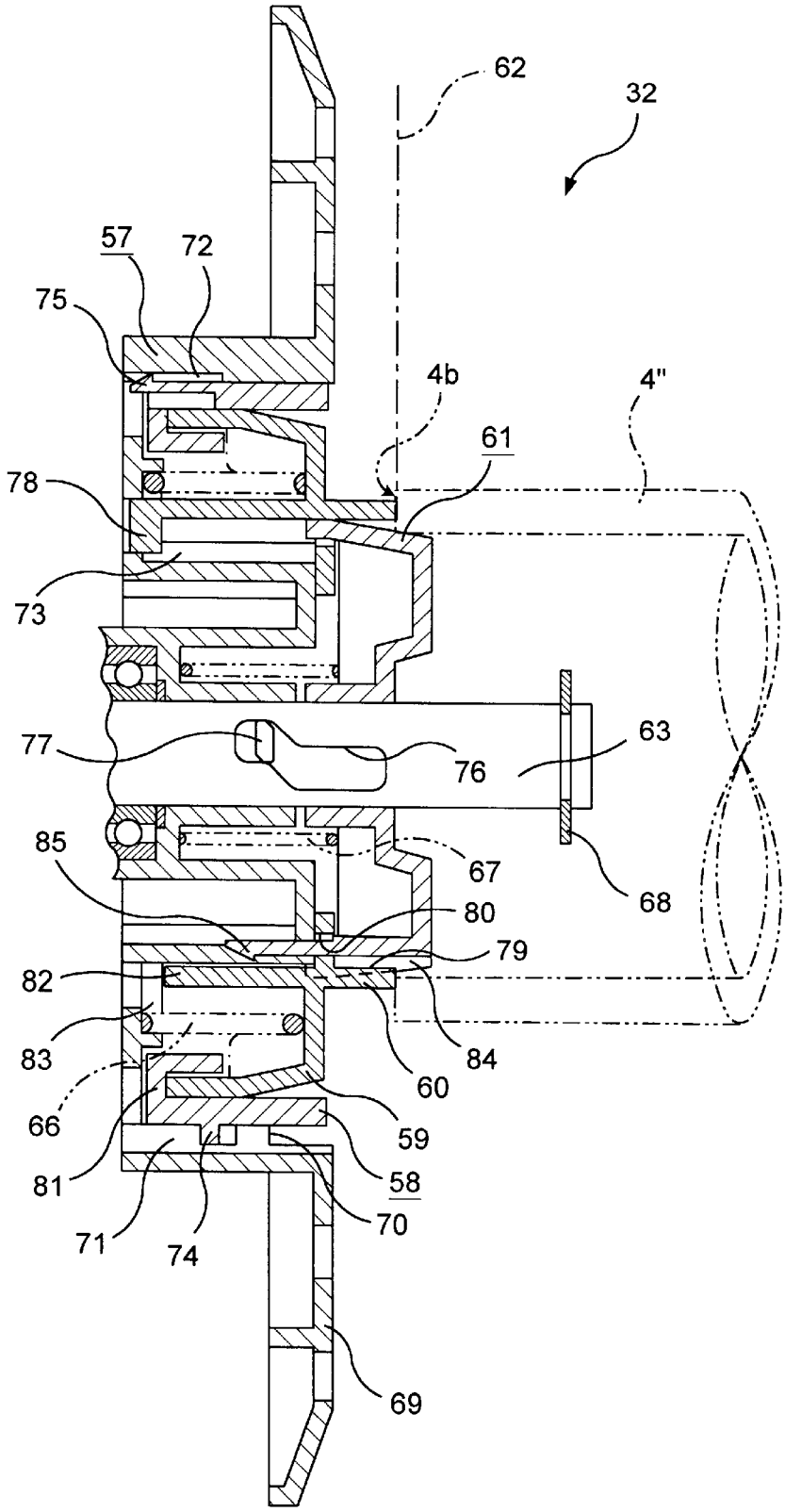
FIG. 21 is a plan view of a center cross-sectional view of the sliding-side core holding mechanism holding a winding core of smaller diameter.

The shape of the cam grooves 76 and the positions of the cam protrusions 77 are configured such that when the winding core 4" of smaller diameter is made contact with and pushed into the smaller diameter reference portion 60, the cam protrusions 77 guide the cam grooves 76 in the rotational direction to rotate the larger diameter reference portion 58, and the protrusions 74 on the larger diameter reference portion 58 come off the protrusion raising portions 70 and fall into the escape grooves 71, as illustrated in FIG. 21. Then, a bottom portion 81 of the larger diameter reference portion 58 is pushed in by the larger diameter centering portion 59 so that the larger diameter reference portion 58 and larger diameter centering portion 59 fall into the base 57 and recede from the periphery of the winding core 4". At the same time, the reference position 62 is determined such that a bottom portion 82 of the smaller diameter reference portion 60 comes into contact with the bottom portion 83 of the base 57 and the end face 4*b* of the winding core 4" is positioned a predetermined distance (for example, 7 mm) away from the inner surface of the flange 69. This also provides a countermeasure to the cause that hinders winding in the same manner as supporting the larger diameter core 4'. Although the gap between the flange 69 and winding core 4" is set 7 mm in this embodiment, it is not limited to this.

The smaller diameter centering portion 61 includes slide protrusions 84, which are guided into the guiding grooves 79 in the smaller diameter reference portion 60, and nails 85 which are caught by the edges of the engaging holes 80 in the smaller diameter reference portion 60. Therefore, the slide protrusions 84 on the smaller diameter centering portion 61 are engaged with the guiding grooves 79 in the smaller diameter reference portion 60 and guided thereto. Accordingly the smaller diameter centering portion 61 is movable in the axial direction of the smaller diameter reference portion 60, but is locked in the rotational direction to rotate together with the reference portion 60. Also, the nails 85 of the smaller diameter centering portion 61 are caught in the engaging holes 80 to prevent the smaller diameter centering portion 61 and reference portion 60 from separating from each other.

The larger spring 66 is arranged as compressed to push open between the base 57 and smaller diameter reference portion 60. The smaller spring 67 is arranged as compressed to push open between the base 57 and smaller diameter centering portion 61.

When the winding core 4' of larger diameter is held by the winding core holding mechanism 8, the device is operated in the following manner. The end portion of the core 4' contacts the larger diameter centering portion 59 as illustrated in FIG. 20, and the core 4' is pushed in against the spring force of the larger spring 66 until the end face 4*a* thereof hits against the larger diameter reference portion 58. Then, the protrusions 74 on the larger diameter reference portion 58 come into contact with the protrusion raising portions 70 of the base 57, and the end face 4*a* of the core 4' is positioned at the reference position 62. When the corner portion of the inner diameter surface of the core 4' pushes the larger diameter centering portion 59 in, a centering is performed by the tapered surface. Moreover, since the spring force of the larger spring 66 is exerted, a sufficient rotational friction resistance can be provided to the rotational torque necessary for winding. To increase the rotational friction resistance necessary for holding the winding core 4, a plurality of narrow grooves may be cut along the axial direction on the outer circumference of the larger diameter centering portion 59.

When the winding core 4" of smaller diameter is held by the winding core holding mechanism 8, the device is operated in the following manner. The end portion of the core 4" contacts the smaller diameter centering portion 61 as illustrated in FIG. 21, and the core 4" is pushed in against the spring force of the smaller spring 67 until the end face 4*b* thereof hits against the smaller diameter reference portion 60. As the smaller diameter reference portion 60 is pushed in against the spring force of the larger spring 66, the cam protrusions 77 on the smaller diameter reference portion 60 come into contact with the cam grooves 76 cut in the larger diameter reference portion 58 and the larger reference portion 58 is rotated according to the inclination of the cam grooves 78. With the rotation of the larger diameter reference portion 58, the protrusions 74 on the larger diameter reference portion 58 come off the protrusion raising portions 70 of the base 57 and becomes movable deeper along the escape groove 71. As the winding core 4" is further pushed, the bottom portion 82 of the smaller diameter reference portion 60 hits against the bottom portion 83 of the base 57. This stops pushing of the winding core 4".

When the core 4" is pushed in, the corner portion at the inner diameter surface of the core 4" contacts the tapered surface of the smaller diameter centering portion 61 to be centered. In addition, since the spring force of both springs 66 and 67 are exerted on the core 4", a sufficient rotational friction resistance can be given to the rotational torque necessary for winding. To increase the rotational friction resistance necessary for holding the core 4, a plurality of narrow grooves may be axially cut in the outer circumference of the smaller diameter centering portion 61.

Figure 18:
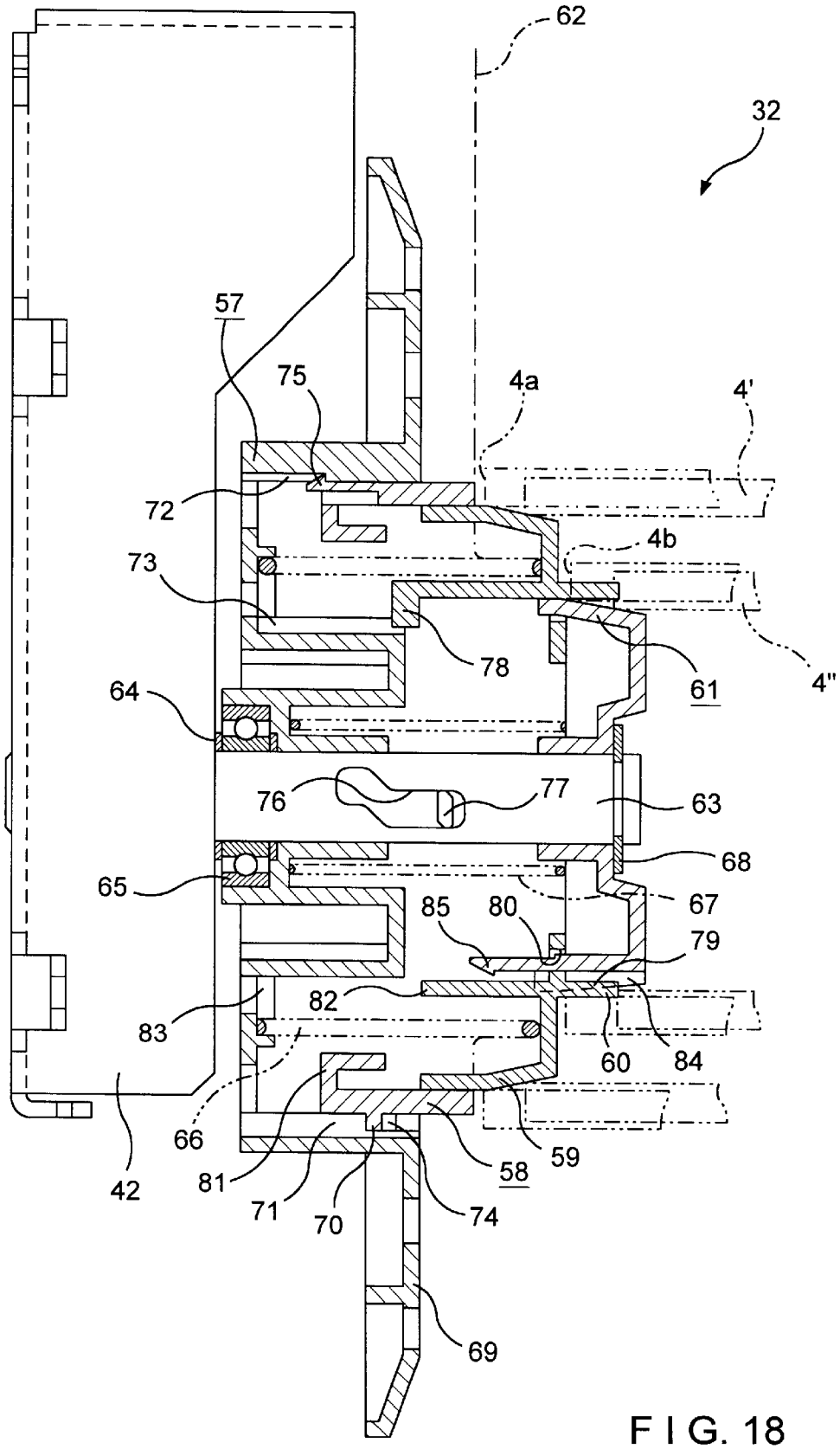
FIG. 18 is a plan view of a center cross-sectional view of a sliding-side core holding mechanism.
Figure 19:
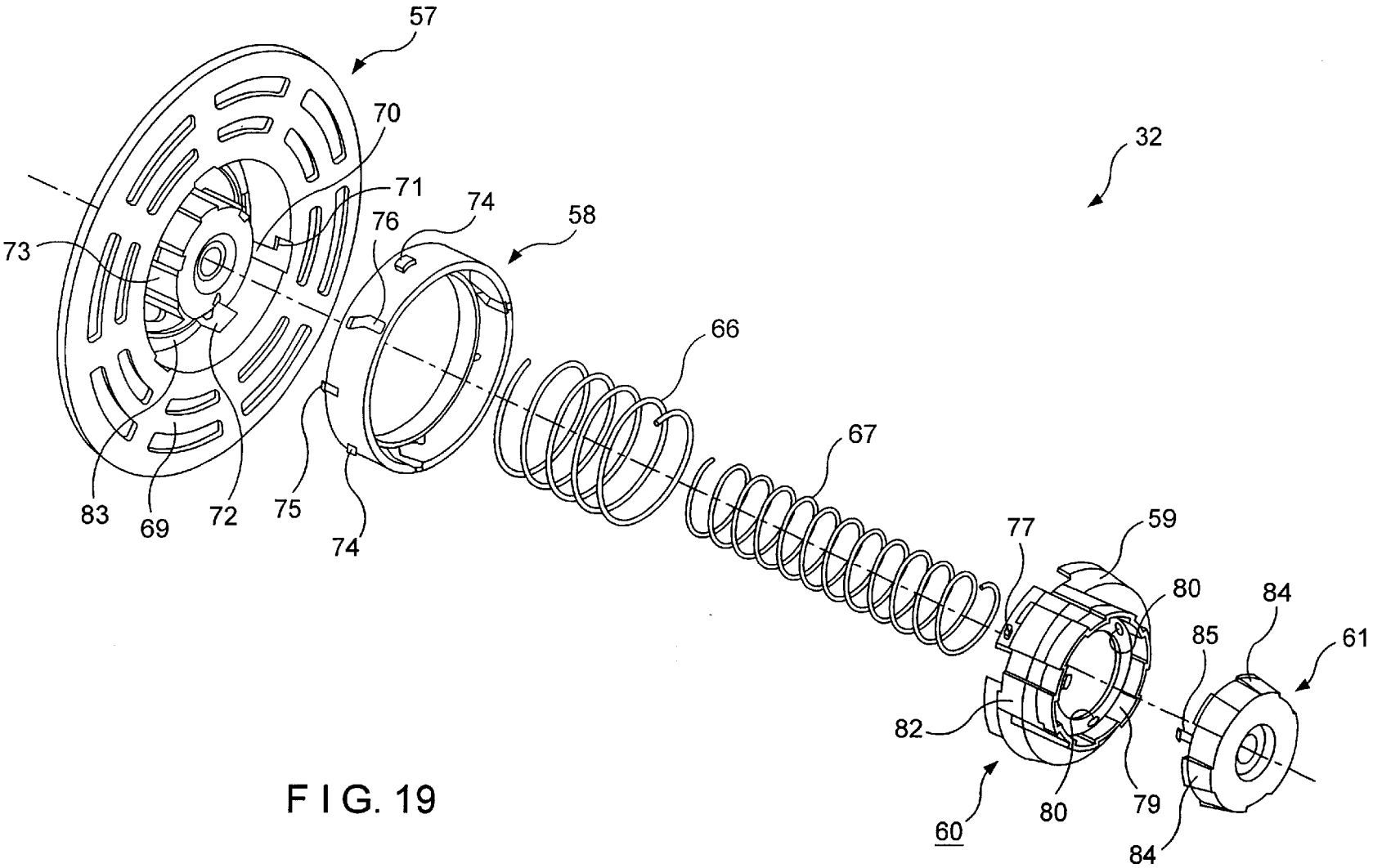
FIG. 19 is a dissembled view of a core holding mechanism.

As the winding core 4" is removed and the pressing is stopped, the smaller centering portion 61 and smaller reference portion 60 are returned to the original positions as illustrated in FIG. 18 by the spring forces of springs 66 and 67. When the smaller reference portion 61 is pushed back, the cam protrusions 77 on the smaller reference portion 60 push up the inclined surfaces of the cam grooves 76 in the larger reference portion 58. Then, when the bottom surfaces of the protrusions 74 on the larger reference portion 58 are moved as low as the protrusion raising portions 70, the cam protrusions 77 rotate the larger reference portion 58 using the cam grooves 76. In the above manner, the device returns to the normal condition.

Figure 22:
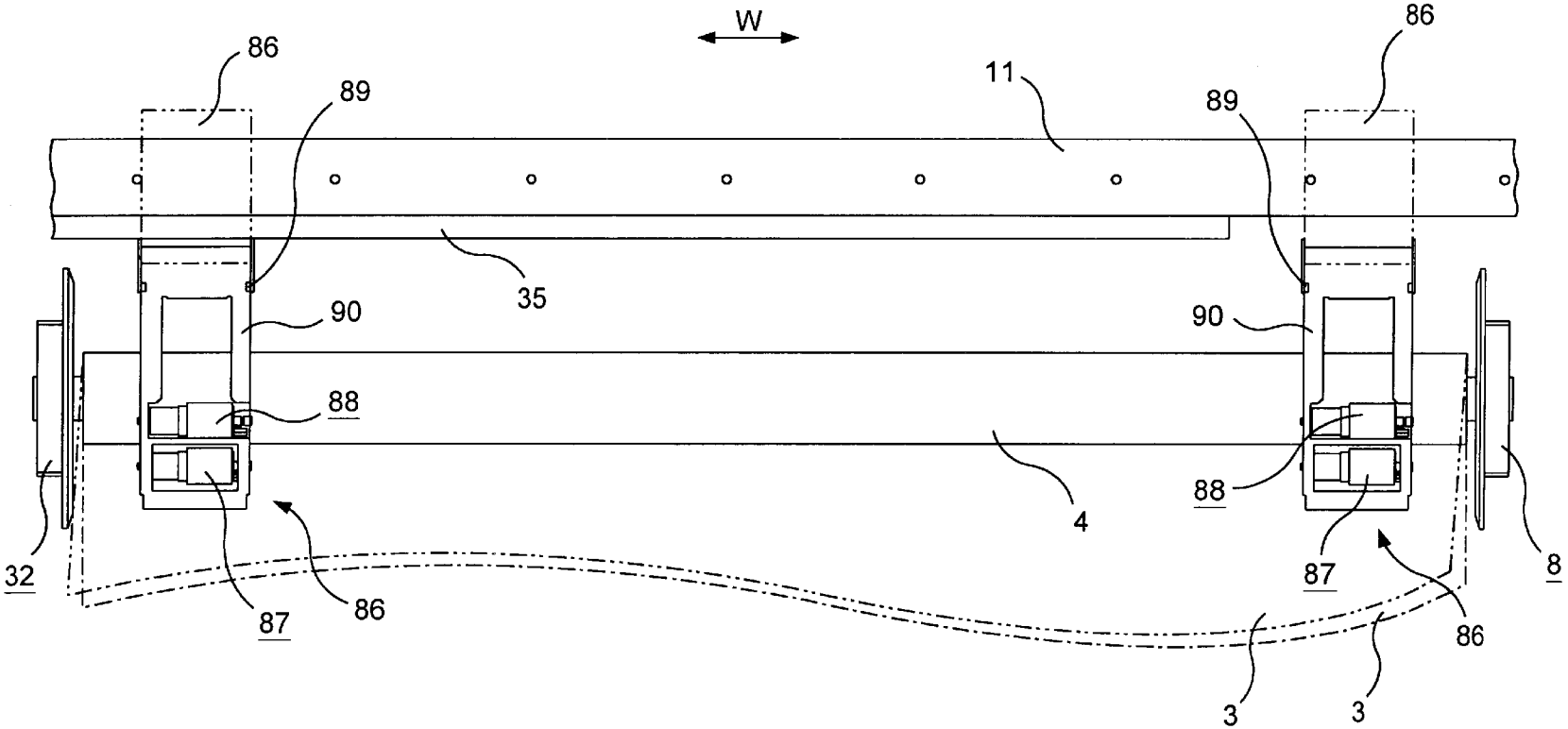
FIG. 22 is a plan view of an obliquely wound medium.
Figure 23:
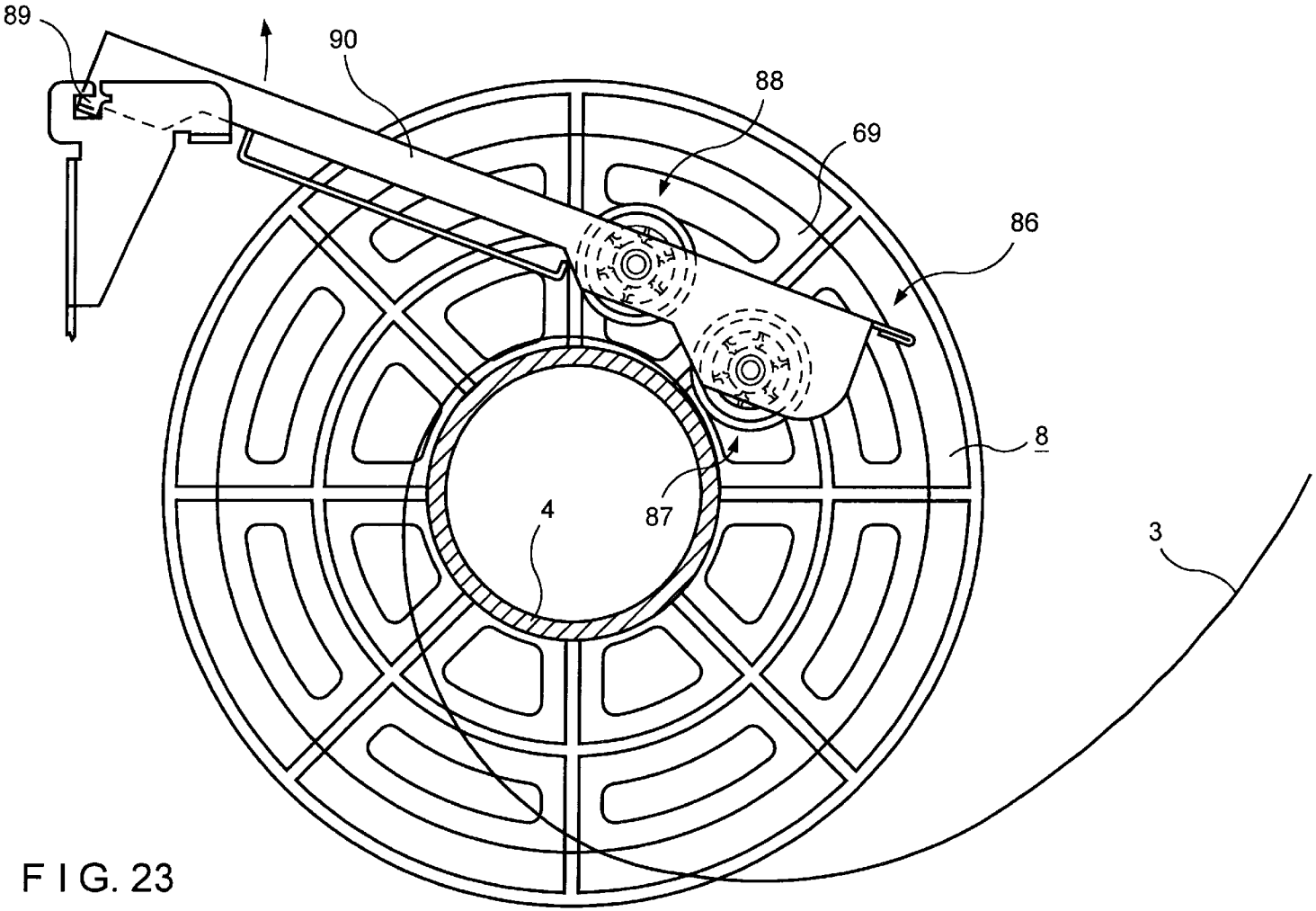
FIG. 23 is a side view of the condition under which the medium is wound correctly.

In this winding device 1, as illustrated in FIG. 22, a roller unit 86 is provided in the vicinity of each end of the core 4 to press the medium 3 tight while it is wound and to prevent the medium 3 from being wound crooked. Each of the roller units 86 consists of a primary roller 87 and a secondary roller 88. The primary roller 87 contacts the medium 3 during the winding of the medium 3 to give resistance (pressure) to the medium 3. The secondary roller 88 contacts the medium 3 individually or together with the primary roller 87 when the medium 3 is wounded obliquely and runs over the core holding mechanisms 8 and 32, so that a larger resistance than that only by the primary roller 87 is given. When the medium 3 is wound straight as shown by the single-dotted line in FIG. 22, the medium 3 is given resistance only by the primary roller 87 in each roller unit 86 as illustrated in FIG. 23, and thus the same resistance is given to both right and left sides of the medium 3. Consequently the medium 3 is lightly pressed and wound up, so that even the medium 3 that cannot tear easily can be tightly wound up.

Figure 24:
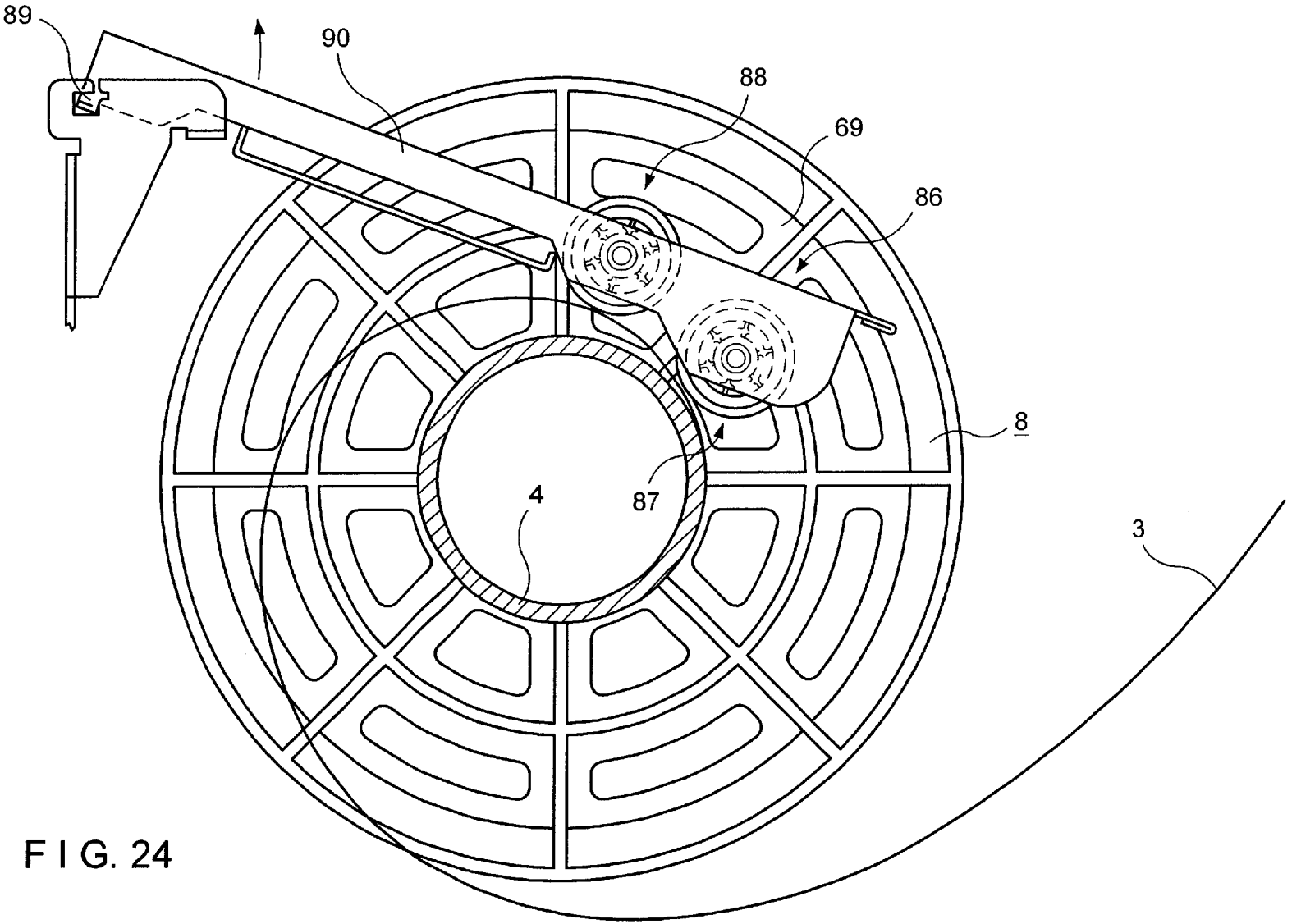
FIG. 24 is a side view of the condition under which the medium wanders off and runs over a flange.

When the medium 3 wanders off and one side edge thereof runs over one of the core holding mechanisms (here, the sliding-side core holding mechanism 32) as shown by the double-dotted line in FIG. 22, the resistance is given to the medium 3 by the secondary roller 88 only or together with the primary roller 87 in the roller unit 86 close to the core holding mechanism 32, over which the medium 3 has run, as illustrated in FIG. 24. On the other hand, the other roller unit 86 on the other end is given a resistance only by the primary 87 because the medium 3 does not expand. For this reason, the winding continues as the expanding side of the medium 3 is given a large resistance while the non-expanding side of the medium 3 is given a small resistance. As a result, the medium 3 is corrected from the oblique winding direction, to the opposite direction of wandering-off. Thus the direction of the oblique winding of the medium 3 is changed to correct the winding direction.

In addition to the primary and secondary rollers 87 and 88, each roller unit 86 further includes a bracket 90, which is mounted capable of swinging up and down with respect to the stay 11 with the work of a hinge 89 and supports the primary and secondary rollers 87 and 88. The bracket 90 switches the contact conditions of the rollers from one under which at least one of the rollers 87, 88 contacts the medium 3 to the other under which none of the rollers 87, 88 contact the medium 3 as the bracket 90 is lifted to the back.

Figure 25:
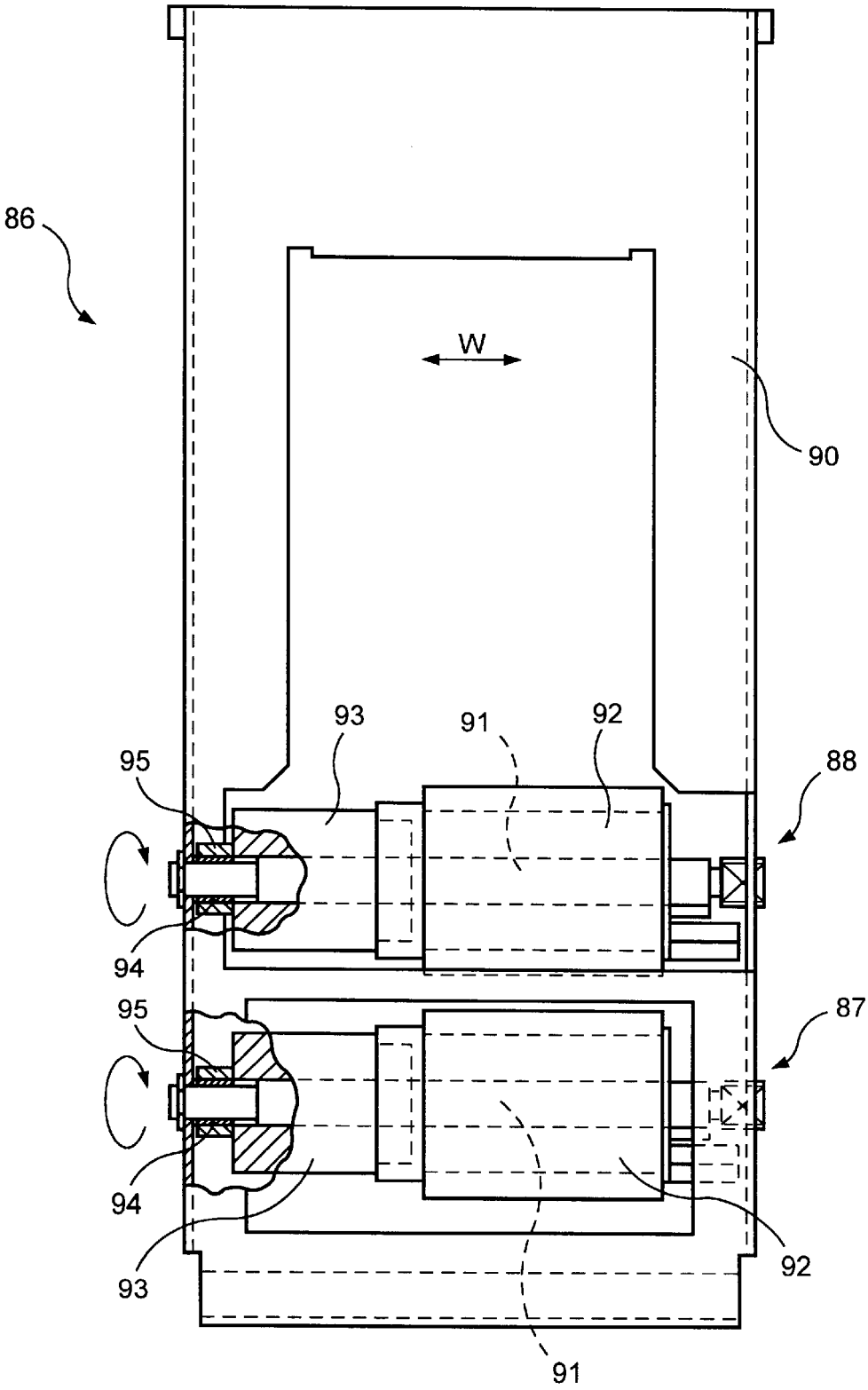
FIG. 25 is a plan view of roller units.
Figure 26:
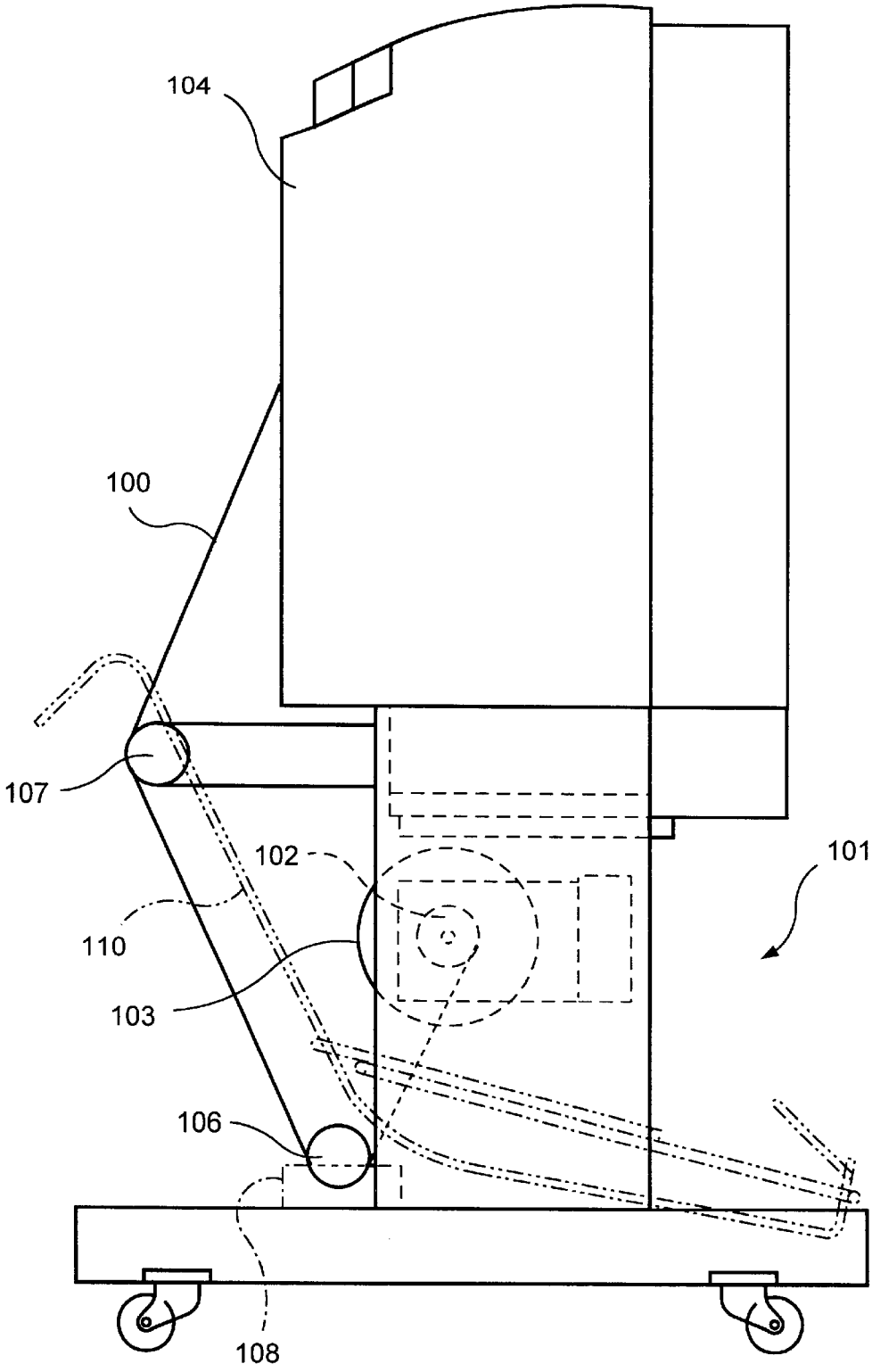
F I G. 26 PRIOR ART
FIG. 26 is a side view of a conventional winding device.
Figure 27:
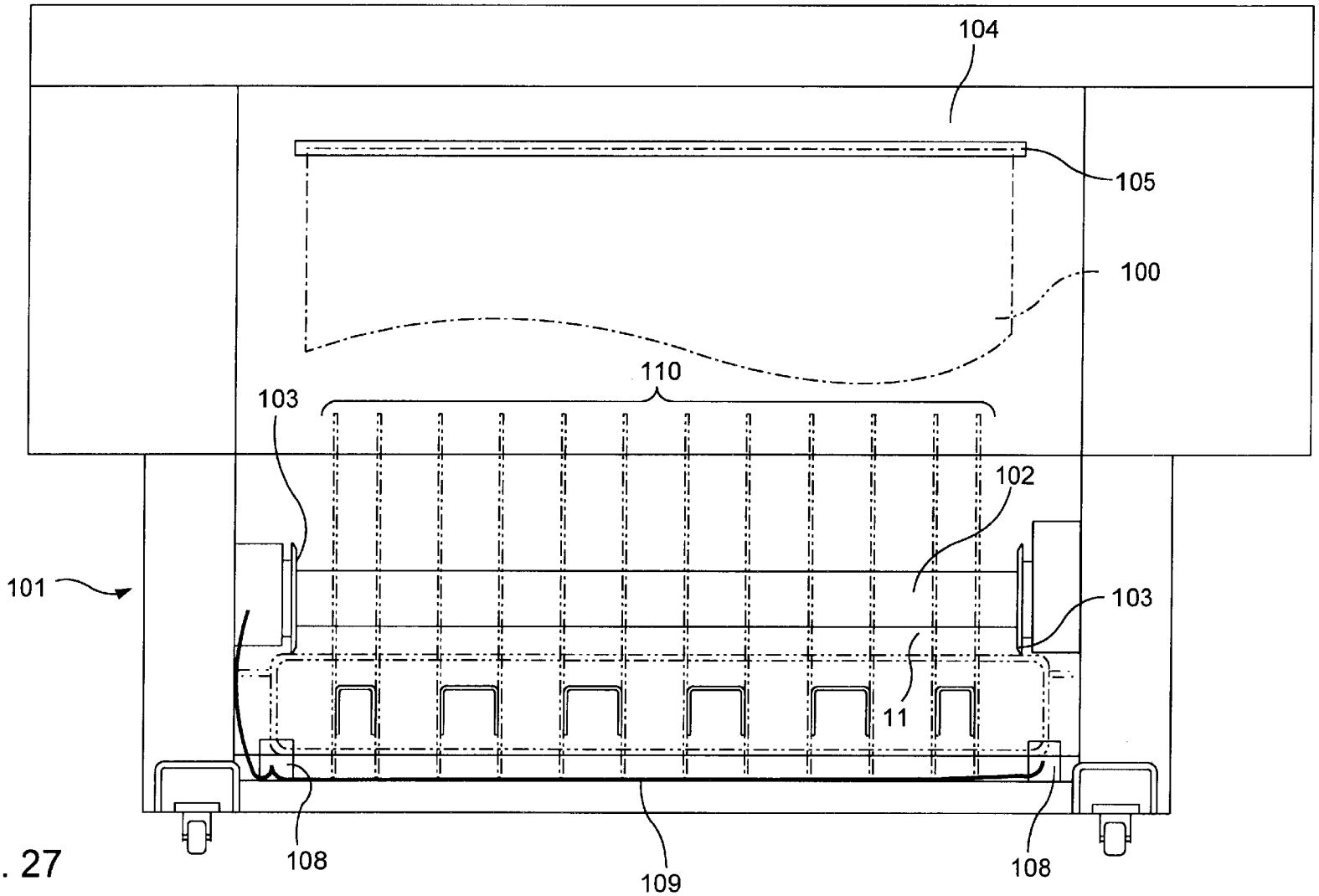
FIG. 27 is a front view of the conventional winding device.

As illustrated in FIG. 25, each of the rollers 87 and 88 consists of a support shaft 91 which is fixed to the bracket 90 to be incapable of rotating and extends along the width direction W, a rubber roller 92, a torque limiter 93, a one-way clutch spring 94, and a spacer 95 which is mounted onto the support shaft 91 in this order. The torque limiter 93 is of a double-layered cylindrical shape and the outer portion thereof is capable of rotating in one direction around the inner portion with a certain force, but is incapable of rotating in the opposite direction. A publicly-known torque limiter can be used. The outer portion of the torque limiter 93 is engaged with the rubber roller 92 to rotate together with the roller 92.

The one-way clutch spring 92 is provided between the inner portion of the torque limiter 93 and the support shaft 91. As rotated in the winding-up direction (shown by arrow in FIG. 25), the one-way clutch spring 94 is wound up tightly and united with the support shaft 91. With this, when the rubber roller 92 rolls touching the medium 3 in the winding direction, the rubber roller 92 and the outer portion of the torque limiter 93 rotate, but the inner portion of the torque limiter 93 does not rotate because the inner portion is fixed to the support shaft 91 by the one-way clutch spring 94. For this reason, a force is exerted as a brake by the torque limiter 93. The strength of the brake force depends on the torque value of the limiter 93.

When the rubber roller 92 is rotated in the direction opposite to the winding direction to pull out the wound-up medium 3, the outer portion and inner portion of the torque limiter 93 are rotated together; since this pulling-out direction is the same direction to which the one-way clutch spring 94 winds and spreads, the outer and inner portions of the limiter 93 rotate around the supporting shaft 91. Consequently the rubber roller 92, torque limiter 93, and one-way clutch spring 94 rotate altogether around the support shaft 91. In other words, the torque limiter 93 does not generate the braking force.

As illustrated in FIGS. 23 and 24, two of rollers 87 and 88 are arranged with a difference in level. Because of this, when the medium 3 is wound without touching the flange 69, only the primary roller 87 contacts the medium 3 as illustrated in FIG. 23; when the medium 3 runs over the flange 69, only the secondary roller 88 contacts the medium 3 as illustrated in FIG. 24.

The operation of the above mentioned winding device 1 to wind the medium 3 on the core 4 will be described hereinafter.

To wind the medium 3 on the core 4 continually, the sheet tray 7 is not attached. The core 4 is mounted to the roll medium holding device 44. At that time, an end portion of the core 4 is first attached to the fixed-side core holding mechanism 8, then the sliding-side core holding mechanism 32 is slid until it hits against the end faces 4*a* and 4*b* of the core 4, and finally the core 4 is sandwiched between the core holding mechanisms 8 and 32. Thus, the core 4 is kept held unless the operation lever is operated. Because the core 4 is held by the core holding mechanisms 8 and 32, the alignment of the end faces 4*a* and 4*b* of the core 4 with the reference position can be automatically performed no matter which size the core is.

After the core 4 is mounted, the output by the printer 2 is started. As the front end of the medium 3 reaches the core 4 with extra length, it is attached to the core 4 with a scotch tape. Even after this, the printer 2 continues its output.

As the printer 2 continues printing out the medium 3, the medium 3 becomes very loose. The detecting sensor 6 detects the looseness of the medium 3. With this, the driving portion 9 is actuated so that both core holding mechanisms 8 and 32 and the core 4 are rotated together to start winding the medium 3. While the medium 3 is being wound, the printer 2 still keeps printing out the medium 3. However, since the speed of winding the medium 3 is faster than the output speed of the printer 2, the looseness of the medium 3 decreases, and finally the detecting sensor 6 no longer detects the looseness. At this point, the operation of the driving portion 9 is stopped to stop winding the medium 3.

As the medium 3 becomes very loose, it is wound up; as the medium 3 is tensioned, the operation of winding-up is stopped. By repeating these operations, the medium 3 output by the printer 2 can be wound on the core 4 of the winding device 1. When wound, the medium 3 is pressed by the first rollers 87 on the left and right sides, resulting in a tight winding.

The medium 3 may wander off during winding, as shown by the double-dotted line in FIG. 22, due to a slightly crooked end portion of the medium 3 when attached with a scotch tape. If this happens, the side edge of the medium 3 comes into contact with the flange 69 and it traces a spread course as illustrated in FIG. 24. As the medium 3 becomes loose around the core 4, the secondary roller 88 comes into contact with the medium 3. At the same time, since the medium 3 goes away from the flange 69 on the other side, the winding on that side does not increase and the primary roller 87 is in contact with the medium 3.

For this reason, the brake forces of different levels are generated at the roller units 86 on the right and left sides. As the roller units keep generating brake forces of different levels, the right side of the medium 3, which is given a weaker brake force, has less pressure on winding than the left side of the medium 3 which is given a stronger brake force. Consequently the winding length of the medium is longer on the right side. Because of the difference in the winding lengths on the right and left sides of the medium 3, the oblique winding is eased or the direction of the oblique winding is turned over (corrected). Thus, the oblique winding can be prevented.

To remove the wound-up medium 3 from the winding device 1, the sliding-side core holding mechanism 32 of the winding device 1 is caused to recede to the side. For this, while the operation lever 50 is being pushed toward the receding direction, the slider portion 34 is easily slid. Then, the heavy roll medium 3 can be dismounted easily and safely.

When the medium 3 output by the printer 2 is cut, the sheet tray 7 is attached and the looseness-detecting sensor 6 at the detecting position shown by a broken line in FIGS. 4 and 1 is caused to recede to the back.

The above is operated in the following manner. First, the sensor arm 18 is pushed to the back by a finger and the like. Then, the sensor arm 18 is rotated to rotate the friction plate 20. At that time, the friction plate 20 functions to rotate the clutch gear 21. But, since the clutch gear 21 is meshed with the gear portion 15 of the fixed-side core holding mechanism 8, it does not rotate. For this reason, the friction plate 20 slips against the clutch gear 21. As a result, the entire sensor arm assembly 10 is rotated, and the looseness-detecting sensor 6 is caused to recede to the back. Otherwise, the fixed-side core holding mechanism 32 may be held by hand and turned to the opposite direction to the winding direction to cause the looseness-detecting sensor 6 to recede to the back in the same manner.

A portion of the sensor arm 18 abuts the spool supporting plate 12 or spool reinforcing plate 13 and reaches the receding position as illustrated by the double-dotted line in FIGS. 5 and 1. Even under the condition in which the sensor arm assembly 10 is caused to recede furthest to the back, since the friction plate 20 and clutch gear 21 feel the friction resistance due to the force of the spring 22, they do not move from the positions thereof. The clutch gear 21 is engaged with a decelerating gear train of the motor mechanism 9 via the gear portion 15 of the fixed-side core holding mechanism 8 and the pinion 16 of the motor mechanism 9; therefore, the sensor arm assembly 10 never turns with the weight thereof. Consequently the sensor arm assembly 10 is held at the position where it was stopped by the friction resistance thereof with the friction plate 20.

For causing the looseness-detecting sensor 6 to recede to the back, the operation is not limited to the above manual operation, but the power of the motor mechanism 9 may be used. In this case, the motor mechanism 9 is driven to rotate the fixed-side core holding mechanism 8 in the opposite direction to the winding direction. With this, the clutch gear 21 is rotated counterclockwise in FIG. 4. Then, the friction plate 20 is exerted against the friction resistance counterclockwise by the clutch gear 21, and the entire sensor arm assembly 10 united with the friction plate 20 rotates and is caused to recede to the back. It is understood that, even so, the receded condition can be maintained.

When cutting, the output medium 3 is stopped to start winding with the winding device 1 again, the sheet tray 7 is removed and the looseness-detecting sensor 6 is pulled forward to the looseness-detecting position.

The above operation is performed in the following manner. First, the core 4 is set in the winding device 5. The front edge of the medium 3 output by the printer 2 is attached to the core 4 with a scotch-type tape. By manual operation or turning on a fast forward switch, the core holding mechanism 8 is rotated in the winding direction to wind the medium 3 on the core 4 by more than a single turn. Then, the preparation for winding the medium is completed. In other words, by rotating the fixed-side core holding mechanism 8, the clutch gear 21 engaged with the gear portion 15 of the core holding mechanism 8 is rotated clockwise in FIG. 5. Then, the friction plate 20 is exerted the clockwise rubbing resistance by the clutch gear 21, and the entire sensor arm assembly 10 united with the friction plate 20 rotates to return to the front side in the looseness-detecting position. Also, a portion of the sensor arm 18 abuts to the spool supporting plate 12 or spool reinforcing plate 13 so that the sensor arm assembly 10 is positioned at the looseness-detecting position. Thus, the looseness-detecting sensor 6 automatically returns to the detecting position upon the movement of winding the medium 3. The looseness-detecting sensor 6 always and for certain returns to the detecting position.

When the core holding mechanism 8 starts winding, the gear portion 15 of the fixed-side core holding mechanism 8 continually attempts to rotate the clutch gear 21, but the clutch gear 21 keeps slipping against the friction plate 20. Because of this, the sensor arm assembly 10 does not move from the looseness-detecting position.

Note that although the above described embodiment is an example of the preferred embodiments, the present invention is not limited to this, but can be modified within the scope of the invention. Although the looseness-detecting sensor 6 has the contact lever 28 and photo sensor 29 in this embodiment, a mechanical switch may be used. With a mechanical switch, reliability of detection accuracy, which may be degraded with the optical sensor due to contamination, is improved.

As understood from the above description, according to the described winding device, there is no need to detach/attach a whole or part of the winding device when the sheet tray is attached/detached. Therefore, usability of the device can be improved, and there is no need to manage the components except the sheet tray.

Further, since a contact-type sensor is used in a form of the invention, the detection is kept accurate, while it may be degraded with an optical sensor because the optical axis of the sensor is transgressed due to contamination or shifted after installation. Thus, reliability of detection can be improved.

Because the looseness-detecting sensor is integrated with the winding mechanism, there is no need to wire the sensor with the winding mechanism, which is normally required when the optical sensor is used in the printer. This simplifies the operation of installing the sensor in the printer. Also, the looseness-detecting sensor is automatically returned to the detecting position following the movement of winding the medium 3, the looseness-detecting sensor can, for certain, be returned to the detecting position.

Further, since a contact-type sensor is generally less expensive than an optical sensor, the cost of the components can be reduced.

Finally, by using a contact lever as described, the sensor is protected from being bent or damaged when the medium contacts the contact lever.

While the foregoing description and drawings represent the present invention, it will be obvious to those skilled in the art that various changes may be made therein without departing from the true spirit and scope of the present invention.

What is claimed is:

1. A winding device for paper, film, cloth and other thin mediums comprising:

a winding mechanism for winding a thin printable medium output by a printer on a winding core;

a looseness-detecting sensor for detecting looseness of said medium and for actuating said winding mechanism upon such detection;

a sheet tray attached to the printer;

wherein said looseness-detecting sensor is mounted on a moveable sensor arm assembly which is capable of receding from a moving area of said medium in order to not block operation of said sheet tray.

2. The winding device as set forth in claim 1, wherein said looseness-detecting sensor is a mechanical contact-type sensor that performs detection as said medium comes into contact therewith and is integrated with said winding mechanism.

3. The winding device as set forth in claim 2, wherein said looseness-detecting sensor includes a contact lever, with which said media makes contact, which is capable of oscillating with a very small force.

* * * * *